US010524980B2

(12) United States Patent
Naing et al.

(10) Patent No.: US 10,524,980 B2
(45) Date of Patent: Jan. 7, 2020

(54) APPARATUS AND METHOD FOR ASEPTICALLY FILLING PHARMACEUTICAL CONTAINERS WITH A PHARMACEUTICAL FLUID USING ROTARY STAGE

(71) Applicant: Varnx Pharmasystems Inc., Burnaby (CA)

(72) Inventors: Juvenal Naing, Belcarra (CA); Yakov Gofman, Richmond (CA); Marcin Cichy, Surrey (CA); John Senger, New Westminster (CA); Craig Rathe, Vancouver (CA)

(73) Assignee: Vanrx Pharmasystems, Inc., Burnaby (CA)

( * ) Notice: Subject to any disclaimer, the term of this patent is extended or adjusted under 35 U.S.C. 154(b) by 279 days.

(21) Appl. No.: 15/465,516

(22) Filed: Mar. 21, 2017

(65) Prior Publication Data

US 2018/0071168 A1 Mar. 15, 2018

Related U.S. Application Data

(63) Continuation-in-part of application No. 15/264,554, filed on Sep. 13, 2016.

(51) Int. Cl.
*A61J 1/20* (2006.01)
*B65B 3/00* (2006.01)
(Continued)

(52) U.S. Cl.
CPC ..... *A61J 1/2003* (2015.05); *B65B 3/003* (2013.01); *B65B 7/161* (2013.01); *B65B 7/28* (2013.01);
(Continued)

(58) Field of Classification Search
CPC ..... B65B 43/50; B65B 43/60; B65B 3/003; B65B 7/161; B65B 7/28; B65B 7/2821;
(Continued)

(56) References Cited

U.S. PATENT DOCUMENTS 1,456,690 A * 5/1923 Goldberger ..... B23Q 16/065 141/150
3,058,276 A * 10/1962 Palma ..... A61J 9/00 141/92
(Continued)

FOREIGN PATENT DOCUMENTS

CN 105271086 1/2016
DE 102006039120 A1 * 3/2008 ..... A61M 5/008
(Continued)

OTHER PUBLICATIONS

PCT International Search Report (PCT/CA2017/051071), dated Nov. 23, 2017.
(Continued)

*Primary Examiner* — Nathaniel C Chukwurah
*Assistant Examiner* — Lucas E. A. Palmer
(74) *Attorney, Agent, or Firm* — Kevin R. Erdman; Brannon Sowers & Cracraft PC

(57) ABSTRACT

A reconfigurable nest handling system for handling nests of objects arranged in a predetermined pattern is presented and applied to a system for filling nested pharmaceutical containers with a pharmaceutical fluid. In one general aspect, the system comprises a sterilizable chamber containing a planar rotary stage with tub and nest positioning systems that may be reconfigurable for holding differently sized pharmaceutical container tubs and nests and pharmaceutical closure tubs and nests. The chamber has a rotatable cover removal station, a rotatable filling station with a dispenser head, and camera guided vacuum pickup facilities for han-
(Continued)

dling container and closure nests. The vacuum pickup facilities may be reconfigurable for handling differently sized nests. An associated method for filling the containers comprises establishing an aseptic condition within the chamber; removing covers from a container tub and a container closure tub by operating both the rotary stage and the cover removal station. The vacuum pickup facility transfers into the fiducial locating structure a container nest bearing pharmaceutical containers. The fluid is dispensed into the containers by operating both the rotary stage and the filling station. A container closure nest is placed on the container nest in the fiducial locating structure with closures in correspondence with containers. A ram in the chamber forces the closures into the containers.

35 Claims, 14 Drawing Sheets

(51) Int. Cl.

| | |
|---|---|
| ***B65B 43/50*** | (2006.01) |
| ***B65B 55/02*** | (2006.01) |
| ***B65B 7/28*** | (2006.01) |
| ***B65B 57/02*** | (2006.01) |
| ***B65B 7/16*** | (2006.01) |
| ***B65B 43/60*** | (2006.01) |

(52) U.S. Cl.
CPC ..... *B65B 7/2821* (2013.01); *B65B 43/50* (2013.01); *B65B 43/60* (2013.01); *B65B 55/027* (2013.01); *B65B 57/02* (2013.01)

(58) Field of Classification Search
CPC ..... B65B 55/027; B65B 57/02; B65B 35/38; B65B 59/00; A61J 1/2003; A61J 3/074; B01F 13/1058; B67C 3/225
USPC ..... 53/471, 281, 282, 468, 381.4, 167, 425; 141/144–148
See application file for complete search history.

(56) References Cited

U.S. PATENT DOCUMENTS 3,219,416 A * 11/1965 Natelson ..... G01N 35/025 141/129
3,431,702 A * 3/1969 Spaulding ..... B65B 21/16 414/627
3,712,021 A * 1/1973 Logemann ..... B65B 7/285 53/329
3,774,778 A * 11/1973 Flaig ..... B65B 35/38 414/591
3,924,384 A * 12/1975 Kinney ..... B65B 7/28 53/485
4,020,881 A * 5/1977 Nothen ..... A01G 9/081 141/1
4,048,781 A * 9/1977 Johansen ..... B29C 51/18 53/453
4,073,372 A * 2/1978 List ..... B65B 43/50 141/169
4,195,465 A * 4/1980 Stokkers ..... B65B 7/28 493/102
4,282,698 A * 8/1981 Zimmermann ..... B65B 7/164 221/223
4,297,828 A * 11/1981 Krieger ..... B65B 7/2807 53/276
4,335,760 A * 6/1982 Kabadi ..... B65B 3/003 141/129
4,415,085 A * 11/1983 Clarke ..... A61J 1/05 206/526
4,498,275 A * 2/1985 Baron ..... B65B 3/36 53/282
4,508,148 A * 4/1985 Trechsel ..... B65B 3/36 141/140
4,516,380 A * 5/1985 Buckner ..... B29C 65/7882 53/282
4,768,919 A * 9/1988 Borgman ..... B65G 47/91 53/495
4,901,504 A * 2/1990 Tsuji ..... B65B 7/2807 53/247
4,985,846 A * 1/1991 Fallon ..... B25J 9/1697 348/86
5,301,488 A * 4/1994 Ruhl ..... B67C 7/00 53/282
5,519,984 A * 5/1996 Beussink ..... B65B 3/003 53/324
5,623,810 A * 4/1997 Dey ..... B65B 9/04 53/281
5,927,474 A * 7/1999 Owen ..... B65G 47/846 198/474.1
6,003,286 A * 12/1999 Goodman ..... B65B 5/08 53/244
6,164,044 A * 12/2000 Porfano ..... B65B 55/10 422/28
6,199,350 B1 * 3/2001 Brechel ..... B65B 59/00 53/109
6,267,256 B1 * 7/2001 Thilly ..... A61M 5/008 211/60.1
6,457,496 B1 * 10/2002 Chuang ..... B01F 13/1058 141/100
7,365,343 B2 * 4/2008 Thilly ..... A61L 2/0011 141/11
7,421,831 B2 * 9/2008 Neeper ..... B65B 7/2821 53/321
7,783,383 B2 * 8/2010 Eliuk ..... A61J 1/20 141/1
7,985,375 B2 * 7/2011 Edens ..... G01N 35/0099 422/50
8,191,339 B2 * 6/2012 Tribble ..... B65B 3/003 53/281
8,479,782 B2 * 7/2013 Mastio ..... A61L 2/082 141/144
8,490,790 B2 * 7/2013 Cocheteux ..... A61M 5/008 206/364
8,703,492 B2 * 4/2014 Self ..... G01N 35/04 422/63
8,763,350 B2 * 7/2014 Bottger ..... B65B 3/003 53/440
9,156,598 B2 * 10/2015 Nicoletti ..... A61M 5/002
9,517,854 B2 * 12/2016 Zardini ..... B65B 57/00
9,937,100 B1 * 4/2018 Joplin ..... B65C 3/08
10,308,381 B2 * 6/2019 Guggisberg ..... G01N 35/0099
2003/0037514 A1 * 2/2003 Hartness ..... B65B 21/183 53/471
2003/0041560 A1 * 3/2003 Kemnitz ..... B65B 7/2828 53/331.5
2003/0056466 A1 * 3/2003 Muneyasu ..... B65B 3/003 53/75
2004/0139698 A1 * 7/2004 Grifols Lucas ..... A61L 2/07 53/426
2005/0045242 A1 * 3/2005 Osborne ..... B65B 3/003 141/27
2005/0160704 A1 * 7/2005 Miksch ..... B65B 69/00 53/492
2005/0194059 A1 * 9/2005 Py ..... B65B 3/003 141/18
2005/0198924 A1 * 9/2005 Benedetti ..... A61L 2/208 53/426
2006/0048844 A1 * 3/2006 Merrill ..... A61L 9/00 141/85
2008/0184671 A1 * 8/2008 Fleckenstein ..... B65B 3/003 53/268
2009/0223592 A1 * 9/2009 Procyshyn ..... B25J 21/00 141/2
2010/0042255 A1 * 2/2010 Boutin ..... G07F 11/165 700/242

(56) References Cited

U.S. PATENT DOCUMENTS

2010/0050574 A1* 3/2010 Cedrone ..... B67C 7/00 53/471
2010/0058711 A1* 3/2010 Blumenstock ..... B65B 7/285 53/64
2010/0180551 A1* 7/2010 Duethorn ..... B65B 7/2821 53/467
2010/0281829 A1* 11/2010 Leu ..... B65B 5/045 53/415
2011/0146841 A1 6/2011 Ansaloni
2011/0153066 A1* 6/2011 Terzini ..... B65B 5/103 700/231
2011/0302884 A1* 12/2011 Monti ..... B65B 3/003 53/281
2012/0090268 A1* 4/2012 Krauss ..... B65B 3/003 53/281
2012/0110952 A1* 5/2012 Zardini ..... B08B 3/022 53/425
2012/0240518 A1* 9/2012 Pairaud ..... B67B 3/18 53/281
2013/0067867 A1* 3/2013 Veile ..... B65B 43/42 53/471
2014/0034545 A1* 2/2014 Pawlowski ..... B65D 25/101 206/565
2014/0165506 A1* 6/2014 Deppermann ..... B65B 43/44 53/471
2014/0196411 A1 7/2014 Procyshyn et al.
2015/0027585 A1* 1/2015 Mengibar Rivas ..... B65B 43/50 141/94
2016/0200461 A1 7/2016 Broadbent et al.
2017/0081060 A1* 3/2017 van der Meijden .... B65B 43/50
2017/0210609 A1* 7/2017 Lufkin ..... B67C 7/0033
2017/0283101 A1* 10/2017 Gorbatenko ..... B65D 85/8043
2018/0008946 A1* 1/2018 Macedo ..... B01F 13/1058
2019/0111435 A1* 4/2019 Gong ..... B01L 7/52
2019/0135466 A1* 5/2019 Gorbatenko ..... B65B 29/022

FOREIGN PATENT DOCUMENTS

DE 102006039120 A1 3/2008
JP 2012017137 1/2012

OTHER PUBLICATIONS

Canadian Patent Office, Written Opinion of the International Searching Authority, International Application No. PCT/CA2017/051071, dated Dec. 11, 2017.

* cited by examiner

APPARATUS AND METHOD FOR ASEPTICALLY FILLING PHARMACEUTICAL CONTAINERS WITH A PHARMACEUTICAL FLUID USING ROTARY STAGE

CROSS-REFERENCE TO RELATED APPLICATION

This application is a continuation-in-part of U.S. application Ser. No. 15/264,554, filed Sep. 13, 2016, which is herein incorporated by reference.

BACKGROUND OF THE INVENTION

Field of the Invention

This present invention relates to the medical field and more particularly to apparatus and associated methods for sterilization of and sterile handling of pharmaceutical materials and containers for pharmaceuticals, including bringing pharmaceuticals into form for administration to medical or veterinary patients. In one aspect, it relates to the programmed and automatic operation of such apparatus.

Background

The subject of filling pharmaceuticals into pharmaceutical containers is a major aspect of the Pharmaceuticals Industry. The subject is heavily controlled by various governmental and official bodies in various countries. Technologically, the subject is a challenge in that the pharmaceutical products need to be filled into the containers under very strict aseptic conditions. Very specific procedures are specified for this task to a degree that makes the handling of pharmaceuticals profoundly different from the handling of any other industrial product, including specifically semiconductors, which also demand extreme and consistent environmental conditions. Indeed, the parallels between the handling of semiconductors in semiconductor "clean laboratories" and the handling of pharmaceuticals in aseptic isolators are superficial. They share the use of such "clean laboratories", but there is no inherent aseptic requirement associated with semiconductor manufacture.

The filling of pharmaceutical containers with fluid pharmaceuticals specifically requires the aseptic handling of both the containers and the fluid pharmaceutical itself. This leads to complex mechanisms and procedures, many of which may be automated to one degree or another. Often, the production equipment for fluid pharmaceutical handling is bulky and expensive. This creates a problem for smaller operations, particularly in the small-scale production and development environments. As the field has developed, the need for smaller, more compact equipment, particularly in the filling and compounding of fluid pharmaceuticals, has become evident.

The prior art is typically characterized by the use of vibratory bowls and escapements. Many prior art systems also employ gloves for use by the operator to access the interior of the chamber.

SUMMARY OF THE INVENTION

In one general aspect, the invention features a method for filling nested pharmaceutical containers with a pharmaceutical fluid substance, such as a liquid, solution, or suspension having therapeutic properties. The method includes providing a filling system comprising a sterilizable chamber capable of maintaining an aseptic condition, with the chamber comprising a filling station and a planar rotary stage having a destination fiducial locating structure including constraining surfaces. The method also includes transferring into the chamber at least one container tub sealed by a container tub cover and containing a container nest bearing a plurality of pharmaceutical containers, aseptically sealing the chamber, and establishing an aseptic condition within the chamber. The container nest bearing the plurality of pharmaceutical containers is transferred into the destination fiducial locating structure such that the container nest is held in place by the constraining surfaces, and the pharmaceutical fluid substance is dispensed into at least a portion of the plurality of pharmaceutical containers by operating both the rotary stage and the filling station.

In preferred embodiments the operating the filling station can include rotating the filling station. The dispensing the pharmaceutical fluid substance can comprise dispensing the pharmaceutical fluid substance on an iterative and serial basis into the containers. Providing a filling system can comprise providing a filing apparatus comprising at least one cover removal station within the chamber, with the transferring into the destination fiducial locating structure the container nest comprising removing the container tub cover from the container tub by operating both the rotary stage and the at least one cover removal station. Operating the at least one cover removal station can comprise rotating the at least one cover removal station. Providing the filling system can comprise providing within the chamber at least one cover removal station having an engagement tool, transferring into the chamber at least one container tub can comprise attaching to the container tub cover a cover removal fixture, and operating the at least one cover removal station can comprise engaging the engagement tool with the cover removal fixture.

The method can further comprise transferring into the chamber a container closure tub sealed by a container closure tub cover and containing at least one container closure nest bearing a plurality of pharmaceutical container closures. The method can further comprise positioning one of the at least one closure nests to align closures in the at least one closure nest with corresponding containers in the container nest, transferring the nests of aligned closures and containers to the ramming station by rotating the rotary stage, and forcing the closures into the corresponding containers. Positioning one of the at least one closure nests can comprise obtaining image information about the one of the at least one closure nest, and positioning the one of the at least one closure nests based on the image information.

Positioning one of the at least one closure nest can comprise applying a vacuum to suction cups, lifting the container closure nest with the suction cups, and operating the rotary stage. Transferring into the destination fiducial locating opening the container nest can comprise applying a vacuum to suction cups, lifting the container nest with the suction cups, and operating the rotary stage. Dispensing the pharmaceutical fluid substance can comprise simultaneously and/or serially operating the rotary stage and the filling station, and removing the container tub cover can comprise simultaneously and/or serially operating the rotary stage and the at least one cover removal station.

In another general aspect, the invention features a system for filling nested pharmaceutical containers with a pharmaceutical fluid substance comprising a sterilizable chamber capable of maintaining an aseptic condition. The chamber includes a filling station, and a planar rotary stage having a rotary stage rotation axis and comprising a destination fiducial locating structure including constraining surfaces disposed and shaped to receive and hold a pharmaceutical container nest bearing a plurality of pharmaceutical containers.

In preferred embodiments the filling station can comprise a fluid product dispenser head, with the filling station being configured to be rotatable about a filling station rotation axis parallel to the rotary stage rotation axis to position in combination with rotation of the rotary stage the dispenser head over any one of the plurality of pharmaceutical containers held in the container nest in the destination fiducial locating structure. The chamber can further comprise at least one cover removal station and the rotary stage can further comprise a first source fiducial locating structure including constraining surfaces disposed and shaped to receive and hold a pharmaceutical container closure tub sealed by a container closure tub cover and containing at least one pharmaceutical container closure nest bearing a plurality of pharmaceutical container closures, and at least one second source fiducial locating opening disposed and shaped to receive and hold a pharmaceutical container tub sealed by a container tub cover and containing a pharmaceutical container nest bearing a plurality of pharmaceutical containers.

The at least one cover removal station can be disposed and configured to be rotatable about a cover removal station rotation axis parallel to the rotary stage rotation axis to remove in combination with rotation of the rotary stage the container tub cover from the at least one container tub and the container closure tub cover from the container closure tub. At least one cover removal station can comprise an engagement tool disposed and configured to engage with engagement fixtures pre-attached to the container tub cover and to the container closure tub cover.

The system can further comprise at least one camera disposed to obtain image information about at least one of the container nest and the closure nest, and a controller, with the chamber further comprising at least one vacuum pickup system comprising suction cups disposed to engage with the container nests and the container closure nests, the at least one vacuum pickup system being configured in combination with rotation of the rotary stage to lift a pharmaceutical container nest from a pharmaceutical container tub held in one of the at least one second source fiducial locating openings and to deposit the pharmaceutical container nest in the destination fiducial locating opening in combination with rotation of the rotary stage and to lift a pharmaceutical container closure nest from a pharmaceutical container closure tub held in the first source fiducial locating opening and to deposit the container closure nest on top of the pharmaceutical container nest under control of the controller.

The controller can be operative to instruct the at least one camera to provide to the controller the image information and the controller can be operative to control the rotation of the rotary stage to place the closures in the closure nest in correspondence with containers in the container nest. The system can further comprise a ram system configured for forcing the closures into the corresponding containers.

The system can further comprise at least one rotatable cover removal station having a cover removal station rotation axis parallel to the rotary stage rotation axis, at least one vacuum pickup system for placing the container closure nest on the container nest with closures in the closure nest in correspondence with containers in the container nest, and a ram system for forcing the closures into the containers, with the filing station being a rotatable filling station having a filling station rotation axis parallel to the rotary stage rotation axis and comprising a fluid product dispenser head. The system can further comprise at least one camera for obtaining image information of at least one of the container nest and the closure nest, and a controller comprising a memory and a processor. The controller can be operative to instruct the rotary stage to rotate to angular positions that are one of predetermined and based on the image information and to control the at least one cover removal station, the filling station, the at least one vacuum pickup system, and the ram system to operate in conjunction with the rotary stage.

In a further general aspect, the invention features a system for filling nested pharmaceutical containers with a pharmaceutical fluid substance that includes means for establishing and maintaining an aseptic condition in a chamber, means for constraining a container nest bearing a plurality of pharmaceutical containers in the chamber, and means for transferring a container nest to the means for constraining from a container tub in the chamber. It also includes means for rotating the means for constraining in the chamber; and means for dispensing the pharmaceutical fluid substance into at least a portion of the plurality of pharmaceutical containers in the container nest while the container nest is constrained by the means for constraining.

In a further aspect, a system is provided for filling nested pharmaceutical containers with a pharmaceutical fluid substance, the system comprising a sterilizable chamber capable of maintaining an aseptic condition, the chamber comprising: a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, and a container filling station having a dispensing head for filling the containers while they are held in a nest at one of the locating structures. The locating structures may include surfaces associated with a first tub-holding opening in the rotary stage for holding a first tub containing at least one nest of containers, surfaces associated with a second tub-holding opening in the rotary stage for holding a second tub containing at least one nest of closures, and surfaces associated with a destination nest-holding opening in the rotary stage for holding at least one nest.

The chamber may further comprise at least one vacuum pickup system comprising suction cups disposed to engage with the container nest and container closure nest held on the rotary stage, the at least one vacuum pickup system being configured in combination with rotation of the rotary stage to lift a pharmaceutical container nest from a pharmaceutical container tub and to deposit the pharmaceutical container nest in the destination opening in combination with rotation of the rotary stage and to lift a pharmaceutical container closure nest from a pharmaceutical container closure tub and to deposit the container closure nest on top of the pharmaceutical container nest.

At least one of the locating structures may include a reconfigurable locating structure with one or more adjustable positioning surfaces to position a tub with respect to the rotary stage. The reconfigurable locating structure may include at least one pair of a reconfigurable stopping member and a restraining member disposed opposite each other across an opening in the rotary stage to precisely position at a first predetermined position a tub that contains at least one nest. The stopping member may be adjustable to stop the tub at the first predetermined position by a rotary adjustment and the restraining member may be disposed to restrain the tub in the first predetermined position.

At least a first of the reconfigurable locating structures may include a rotary positioning element having an axis of rotation parallel to a plane of the rotary stage and includes a plurality of different positioning surfaces that are selectable by rotating the rotary positioning element. At least one of the reconfigurable locating structures may include a pair of opposing rotary positioning elements each having an axis of rotation parallel to a plane of the rotary stage and each may include a plurality of different positioning surfaces that are selectable by rotating the rotary positioning elements to accommodate different nest widths.

At least one of the reconfigurable locating structures may include at least a first pair of opposing positioning elements that define positioning surfaces that oppose each other along a first positioning axis that is at least generally parallel to a plane of the rotary stage and at least a second pair of opposing positioning elements that define positioning surfaces that oppose each other along a second positioning axis that is at least generally parallel to a plane of the rotary stage and at least generally perpendicular to the first positioning axis. The at least one of the positioning elements in each of the first and second pairs of positioning elements may include a rotary positioning element having an axis of rotation parallel to a plane of the rotary stage and including a plurality of different positioning surfaces.

The system may further include a reconfigurable vacuum pickup system comprising: a first set of suction cups arranged in a first pattern, a second set of suction cups arranged in a second pattern different from the first pattern, and a selection mechanism operative to position either the first set of suction cups or the second set of suction cups to engage with the at least a first of the nests of pharmaceutical container parts while it is held by one of the plurality of locating structures. The selection mechanism of the reconfigurable vacuum pickup system may include a rotary mechanism operative to position the first or second sets of suction cups in an engagement position.

The system may further include at least one cover removal station positioned to remove covers from tubs containing at least one nest of pharmaceutical packaging materials held in one of the locating structures. The at least one cover removal station may be rotatable about a cover removal station rotation axis parallel to the rotary stage rotation axis to remove the tub covers in combination with rotation of the rotary stage. The at least one cover removal station may comprises an engagement tool disposed and configured to engage with a cover removal fixture on the tub cover.

The filling station may be configured to be rotatable about a filling station rotation axis parallel to the rotary stage rotation axis to position in combination with rotation of the rotary stage the dispenser head over any one of the plurality of pharmaceutical containers held by one of the one of the locating structures.

The system may further comprise at least one camera disposed to obtain image information about at least one of the nests of pharmaceutical container parts. The system may further comprise a ram system configured for forcing nested closures into corresponding nested containers.

The system may further comprise at least one rotatable cover removal station having a cover removal station rotation axis parallel to the rotary stage rotation axis; at least one vacuum pickup system for placing a container closure nest on a container nest with closures in the closure nest in correspondence with containers in the container nest; a ram system for forcing the closures into the containers; and wherein the filing station is a rotatable filling station having a filling station rotation axis parallel to the rotary stage rotation axis and comprising a fluid product dispenser head.

The system may further comprise at least one camera for obtaining image information of at least one of the container nest and the closure nest, a controller comprising a memory and a processor, and wherein the controller is operative to instruct the rotary stage to rotate to angular positions that are one of predetermined and based on the image information and to control the at least one cover removal station, the filling station, the at least one vacuum pickup system, and the ram system to operate in conjunction with the rotary stage.

In another aspect, a system is provided for filling nested pharmaceutical containers with a pharmaceutical fluid substance, comprising: means for establishing and maintaining an aseptic condition in a chamber; means for constraining a container nest bearing a plurality of pharmaceutical containers in the chamber; means for transferring to the means for constraining a container nest from a container tub in the chamber; means for rotating the means for constraining in the chamber; and means for dispensing the pharmaceutical fluid substance into at least a portion of the plurality of pharmaceutical containers in the container nest while the container nest is constrained by the means for constraining.

In a further aspect, a method is provided for filling nested pharmaceutical containers with a pharmaceutical fluid substance, the method comprising: providing a filling system comprising a sterilizable chamber capable of maintaining an aseptic condition, the chamber comprising a filling station and a planar rotary stage having a destination locating structure; transferring into the chamber at least one container tub sealed by a container tub cover and containing a container nest bearing a plurality of pharmaceutical containers; aseptically sealing the chamber; establishing an aseptic condition within the chamber; transferring into the destination locating structure the container nest bearing the plurality of pharmaceutical containers such that the container nest is held in place; and dispensing the pharmaceutical fluid substance into at least a portion of the plurality of pharmaceutical containers by operating both the rotary stage and the filling station. The operating the filling station may include rotating the filling station. The dispensing the pharmaceutical fluid substance may comprise dispensing the pharmaceutical fluid substance on an iterative and serial basis into the containers.

The providing a filling system may comprise providing a filing apparatus comprising at least one cover removal station within the chamber and wherein the transferring into the destination locating structure the container tub comprises removing the container tub cover from the container tub by operating both the rotary stage and the at least one cover removal station. The operating the at least one cover removal station may comprise rotating the at least one cover removal station. The providing the filling system may comprise providing within the chamber at least one cover removal station having an engagement tool, the transferring into the chamber at least one container tub may comprise attaching to the container tub cover a cover removal fixture; and wherein the operating the at least one cover removal station comprises engaging the engagement tool with the cover removal fixture.

The method may further comprise transferring into the chamber a container closure tub sealed by a container closure tub cover and containing at least one container closure nest bearing a plurality of pharmaceutical container closures. The method may further comprise positioning one of the at least one closure nests to align closures in the at least one closure nest with corresponding containers in the container nest; transferring the nests of aligned closures and containers to a ramming station by rotating the rotary stage; and forcing the closures into the corresponding containers. The method may further include adjusting a tub locating structure to accommodate a size of the closure nest tub. The positioning one of the at least one closure nest may comprise: obtaining image information about the one of the at least one closure nests; and positioning the one of the at least one closure nests based on the image information. The positioning one of the at least one closure nest may comprise: applying a vacuum to suction cups; lifting the container closure nest with the suction cups; and operating the rotary stage.

The transferring into the destination locating opening the container nest may comprise: applying a vacuum to suction cups; lifting the container nest with the suction cups; and operating the rotary stage. The method may further include selecting one of a plurality of sets of suction cups and wherein the applying a vacuum to suction cups is performed for the selected set of suction cups. The selecting may include rotating one of the plurality of sets of suction cups into position. The method may further include the destination locating structure to accommodate a size of the container nest. The adjusting may be performed in two at least generally orthogonal directions. The method may further include adjusting a tub locating structure to accommodate a size of the container nest tub.

In another general aspect, the invention features a container assembly for holding nested pharmaceutical container parts. It includes a container comprising a bottom, a top lip that provides a horizontal top sealing surface that has a peripheral outline, and sidewalls located between the bottom and the top lip. It also includes a peelable container cover consisting of a sheet of flexible material sealed to the sealing surface of the top lip of the rectangular container to seal the contents of the container, and a cover removal fixture on the container cover.

The sealed peelable container cover may include a portion that extends outside of the peripheral outline of the top sealing surface of the container, and the cover removal fixture may be on the portion of the peelable container cover that extends outside of the peripheral outline of the top sealing surface of the container. The container may be rectangular and includes four sidewalls. The cover removal fixture may include an appendage to allow it to be engaged by an engagement tool. The cover removal fixture may include a ball-shaped appendage to allow it to be engaged by an engagement tool. The peelable container cover may be heat sealed to the sealing surface of the top lip of the rectangular container to seal the contents of the container against decontamination. The peelable container cover may be sealed to the sealing surface of the top lip of the rectangular container to seal the contents of the container against decontamination using a chemical agent. The peelable container cover may sealed to the sealing surface of the top lip of the rectangular container to seal the contents of the container against decontamination using a radiation. The peelable container cover may be sealed to the sealing surface of the top lip of the rectangular container to seal the contents of the container against decontamination using plasma. The peelable cover may be made of a plastic material. The peelable cover may be made of an impermeable laminated foil. The peelable cover may be made of a polymeric membrane. The cover removal fixture may be clipped to a portion of the peelable container cover that extends outside of the peripheral outline of the top sealing surface of the container. The sealed container may hold sterilized pharmaceutical containers or closures.

In a further aspect, a method is provided for removing within a controlled environment enclosure a container cover from a sealed container, the sealed container being sealed by the container cover, the method comprising: providing the container in the controlled environment enclosure with the cover sealed to a sealing surface of a lip of the container to seal the contents of the container against decontamination, the cover having a cover removal fixture, decontaminating the sealed container in the controlled environment enclosure, engaging the cover removal fixture with an engagement tool, and removing the cover from the container using the engagement tool. The engaging may engage the cover removal fixture with a fork-shaped engagement tool. The engaging may engage a ball-shaped appendage on the cover removal fixture.

The providing may include providing sterilized pharmaceutical containers or closures in the sealed container before the decontaminating. The attaching may take place before the container is in the controlled environment enclosure. The decontaminating the sealed container in the controlled environment enclosure may take place before the removing the cover. The removing the cover may include moving the engagement tool relative to the container. The removing the cover may include moving both the container and the engagement tool. The method may further comprise attaching the cover removal fixture to the cover before providing the container in the controlled environment enclosure.

Systems and methods according to the invention need not employ either vibratory bowls or escapements. Nor do such systems or method require gloves. Systems and methods according to the invention can therefore address needs for compact, small-scale filling and compounding of fluid pharmaceuticals.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1A:
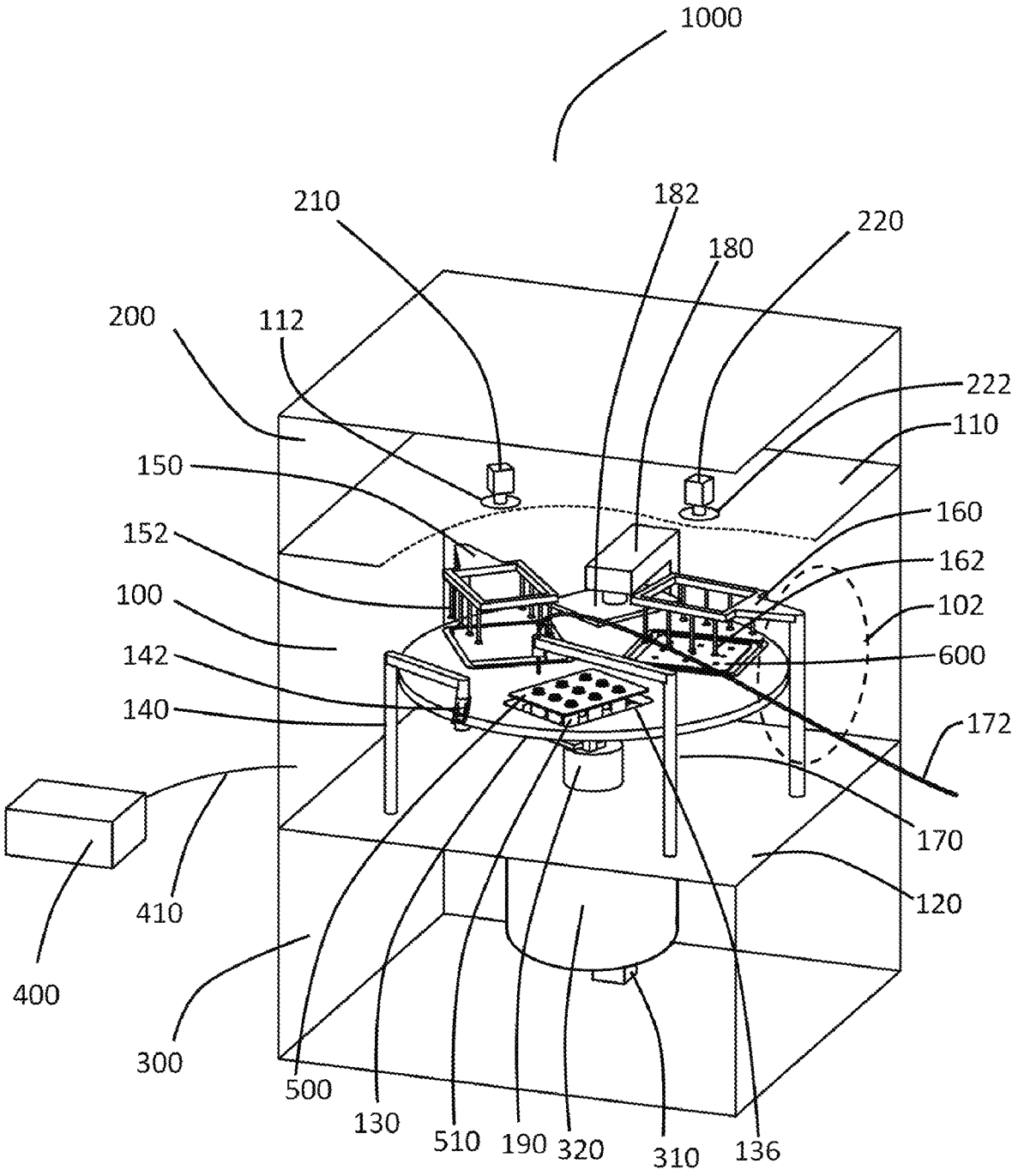
FIG. 1A is a drawing of an apparatus for filling pharmaceutical containers with a pharmaceutical fluid product. For the sake of clarity some surfaces are shown in cutaway form and others are shown as transparent.

Corresponding reference characters indicate corresponding parts throughout the several views. Although the drawings represent embodiments of the present invention, the drawings are not necessarily to scale and certain features may be exaggerated in order to better illustrate and explain the present invention. The flow charts are also representative in nature, and actual embodiments of the invention may include further features or steps not shown in the drawings. The exemplifications set out herein illustrate embodiments of the invention, in one or more forms, and such exemplifications are not to be construed as limiting the scope of the invention in any manner.

DETAILED DESCRIPTION

The embodiments disclosed below are illustrative and not intended to be exhaustive or limit the invention to the precise form disclosed in the following detailed description. Rather, the embodiments are chosen and described so that others skilled in the art may utilize their teachings.

The present invention relates to an apparatus and method for filing pharmaceutical containers with a pharmaceutical fluid substance in a spatially constrained environment. In FIG. 1A, a filling system 1000 comprises a sealable chamber 100 in communication with an ambient environment, the sealable chamber 100 being capable of having an aseptic environment established within its interior and capable of maintaining that aseptic environment within its interior. The interior of sealable chamber 100 may be rendered aseptic by any one or more of a number of treatments, including but not limited to treatment with a sterilant, such as steam, hydrogen peroxide vapor, ozone, nitrogen dioxide, and ethylene oxide. The structures and mechanisms to perform such sterilization steps are well known in the art and are not shown in FIG. 1A.

Chambers 200 and 300 are separated from chamber 100 by upper wall 110 and lower wall 120 respectively and are not required to be capable of maintaining aseptic environments within their interiors. The communication of chamber 100 with the ambient environment may be via a suitable aseptically sealable access door 102, schematically shown in broken outline in FIG. 1A. Suitable sealable doors and ports are well known in the art and will not be dwelt upon further in this specification. The ambient environment may be, for example, a clean room adapted for the handling of pharmaceuticals during production. Since space is at a premium in such spatially constrained clean environments, there is much merit in reducing the so-called "footprint" of equipment to be housed in the clean environment.

The terms "aseptic" and "sterilize" and their derivatives are to be understood as follows for the purposes of the present specification. Establishing an aseptic condition in the interior of a chamber shall be understood to mean establishing that condition throughout the internal atmosphere of the chamber as well as on substantially all exposed interior surfaces of the chamber. This shall include the surfaces of all items, containers, subsystems and the like exposed to the interior atmosphere of the chamber. To the extent that extremely tight crevices or microscopic crevices may exist in the interior of the chamber such that a sterilizing gas or vapor may not perfectly penetrate into such tight regions, for example, the degree of sterilization in practical cases may not be total. This is acknowledged in both the industry and in the standards set for the industry. The action of establishing an aseptic condition within the interior of the chamber and "sterilizing the interior of the chamber" shall have the same meaning in this specification.

Introducing into the interior of a chamber with an aseptic condition an item of which the surfaces are not suitably sterilized destroys the existing aseptic condition within the chamber. Conversely, introducing an aseptic or sterilized item into an interior of a chamber that does not have an aseptic condition within that interior does not render that interior aseptic. In fact, all it does is to destroy the aseptic condition of the surface of the item so introduced. Similarly, introducing filtered air, even with all biological entities filtered out, into an unsterilized chamber does not in any way sterilize the chamber or render it aseptic to a degree acceptable in the pharmaceutical industry. The reason is that the interior surfaces of the chamber are not sterilized by the introduction of such air. All that is achieved is to contaminate the filtered air with active biological species resident on the interior surfaces of the unsterilized chamber.

In the interest of clarity and completeness, it should also be recorded that in the art the term "aseptic" is also sometimes used in association with the introduction of pharmaceutical fluids along aseptic tubes into bodies within controlled chambers. In such cases the term in the art refers to the condition inside the tube or to the fact that the pharmaceutical fluid may be filtered to a suitable degree. This in no way sterilizes or renders aseptic the interior of the chamber in question. The aseptic condition in such cases is confined to the interior of the tube bearing the pharmaceutical stream. Such streams are often filtered to a high degree, but such filtering affects only the interior of the particular tube and does not in any way sterilize the interior of the chamber.

In some prior art systems, containers introduced into a chamber for the purposes of being filled with a pharmaceutical are routed through sterilizing subsystems. This kills biological species on the containers. When such sterilized containers are introduced into the chamber when the chamber itself is not aseptic the containers lose their aseptic condition as biological species contained within the chamber will deposit on the previously aseptic containers.

It should also be pointed out that pharmaceutical or semiconductor clean rooms of any quality level, including "Class 100", "Class 10" or "Class 1", even when employing laminar flow hoods and the like or any quality of HEPA (High Efficiency Particulate Air) filters or ULPA (Ultra Low Particulate Air) filters, cannot constitute an aseptic chamber because they do not have an assurable means to render the surfaces of the room sterile or aseptic. Standards for clean rooms exist from both the United States Federal Government and ISO (International Standards Organization). These specify in great detail to different standards the allowed particulate content of a cubic volume of air in such a clean room facility. None of these standards address the matter of biological species present on surfaces in the room. This serves to make the point that a chamber cannot be rendered aseptic by the management of its atmosphere or airflow only. Nor, conversely, can the chamber be rendered aseptic by the sterilization of only the surfaces of its interior.

The text "Guideline for Disinfection and Sterilization in healthcare Facilities, 2008" by Rutala et al from the Center for Disease Control lists a compendium of mechanisms and methods for sterilization. Our concern in this specification is specifically with those mechanisms for sterilizing the interior of a chamber; that is, sterilizing both the interior surfaces and the atmosphere within the chamber. Given the requirements, vapor base methods are most appropriate to the task. These include, but are not limited to, treatment with heated water vapor, hydrogen peroxide vapor, ozone, nitrogen dioxide, ethylene oxide, glutaraldehyde vapor or other suitable sterilizing gases and vapors. In one suitable method appropriate to the present invention, the sterilization is by means of hydrogen peroxide vapor which is then flushed using ozone before the chamber is employed in the filling of pharmaceutical containers.

The subsystems of the apparatus 1000 contained with sealable chamber 100 will now be described at the hand of FIG. 1A to FIG. 1G. Due to the compactness and density of components and subsystems of apparatus 1000, certain components and subsystems are omitted from the drawings of FIG. 1B to FIG. 1G in the interest of clarity and the focus is placed on components and subsystems most relevant to the supporting text in this specification. Planar rotary stage 130 is fully rotatable through 360 degrees in a horizontal plane parallel to lower wall 120 about rotary stage rotation axis 131 and may be raised and lowered by means of bellows feed-through 190. The use of bellows feed-through 190 allows chamber 100 to retain its aseptic condition during the motion of rotary stage 130. A suitable engine and gearing system 320 may be housed within chamber 300. Engines, for example stepper motors, as well as gearing systems suitable for rotating rotary stage 130 with suitable angular precision and repeatability are well known in the art and are not further discussed in this specification.

Figure 1B:
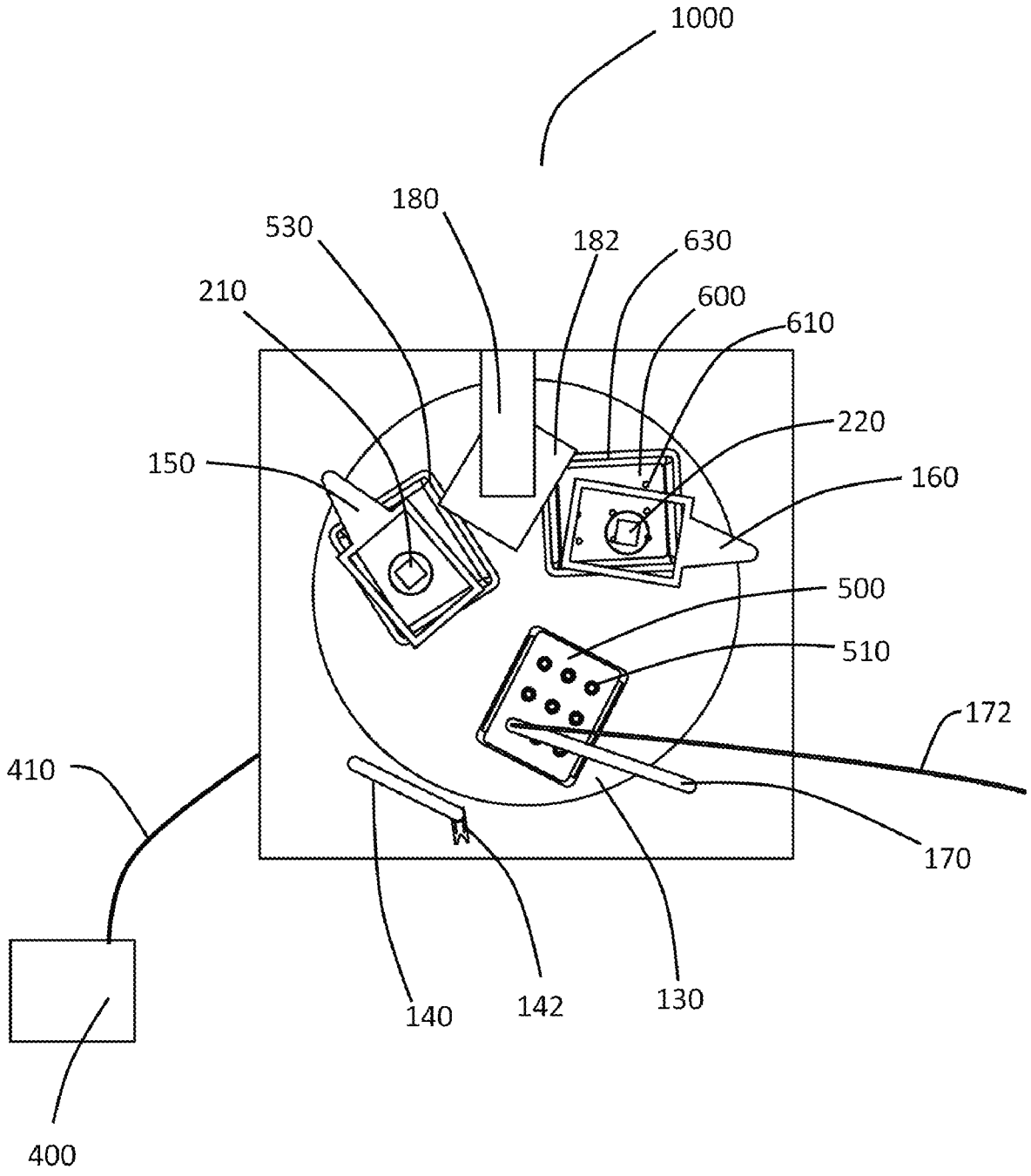
FIG. 1B is a plan view of one chamber of the apparatus of FIG. 1A.
Figure 1C:
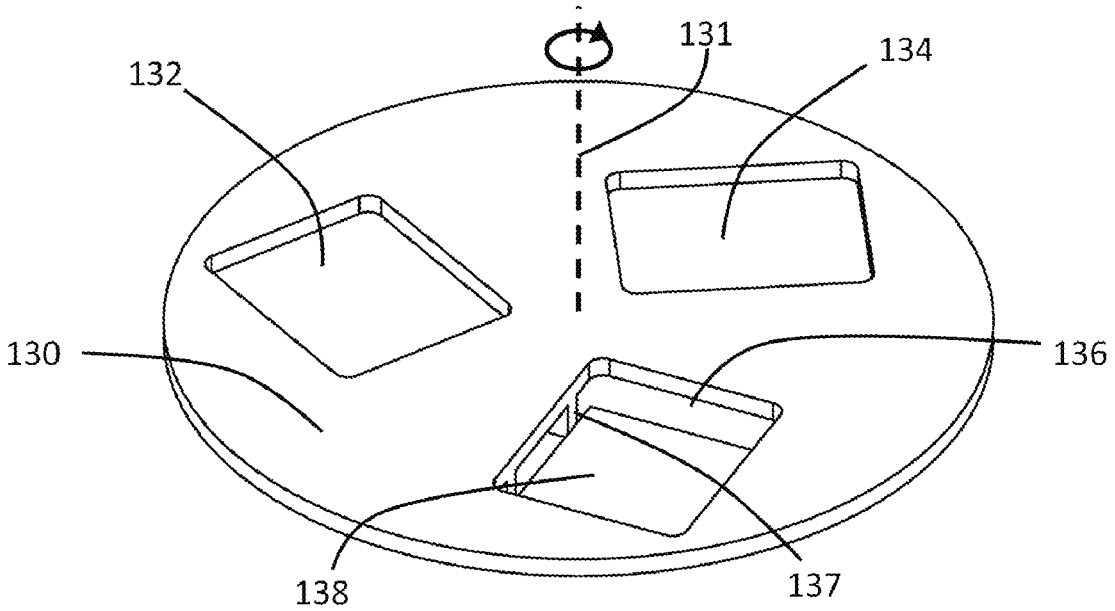
FIG. 1C shows a rotary stage of the apparatus of FIG. 1A and FIG. 1B.

As shown in FIG. 1C, at least three fiducial locating openings 132, 134, and 136 are provided in rotary stage 130. Fiducial locating opening 132 is employed for receiving container tubs 530 holding sterilized pharmaceutical containers 510 pre-packed in a predetermined pattern in container nests 500. The container tubs 530 are typically substantially rectangular and are sealed with peelable covers 520. Suppliers of pharmaceutical containers provide their product in this format to users of the apparatus of the present specification. Fiducial locating opening 134 is employed for receiving container closure tubs 630 holding sterilized pharmaceutical containers closures 610 pre-packed in a predetermined pattern in container closure nests 600. The container closure tubs 630 are typically substantially rectangular and are sealed with peelable tub covers not shown in FIG. 1A to FIG. 1G. The peelable covers of tubs 630 are functionally identical to peelable covers 520. Suppliers of pharmaceutical containers provide their product in this format to users of the apparatus of the present specification. In the interest of the compactness of system 1000, the rectangular axes of locating openings 132, 134, and 136 may be oriented at an angle with respect to the radial direction of the rotary stage 130 in order to ensure a suitably small radius for rotary stage 130.

Suitable container nests 500 and container closure nests 600; container tubs 530 and container closure tubs 630; and peelable tub covers 520 are described in co-pending U.S. patent application Ser. No. 14/912,145, the specification of which is hereby incorporated in full. Alternative cover gripping arrangements for the removal of tub covers from tubs are also described in co-pending U.S. patent application Ser. No. 14/398,538, the specification of which is hereby incorporated in full.

In the interest of clarity, FIG. 1A to FIG. 1G show, and the associated text to follow below will describe, the use of a single tub 530 of pharmaceutical containers 510 along with a single tub 630 of container closures 610. In practice, container closures 610 are provided as multiple nests 600 per container closure tub 630. To this end rotary stage 130 may contain more than one fiducial locating opening 132 to each receive a container tub 530 holding sterilized pharmaceutical containers 510 pre-packed in one container nest 500. In yet other implementations, more than one nest 500 of containers 510 may be present in a single pharmaceutical container tub 530.

Fiducial locating opening 136 is specifically arranged to receive container nests 500 bearing pharmaceutical containers 510. Whereas tubs 530 and 630 naturally locate in fiducial locating openings 132 and 134 and are suspended by their own rims once in opening 132 and 134, containers 510 are correctly located in opening 136 and retained in position by some other means. To this end, fiducial locating opening 136 comprises four fiducial retaining guides 137. Baseplate 138 is located within fiducial locating opening 136 as a loose component of system 1000, and rests on the horizontal portions at the bottoms of each of the four fiducial retaining guides 137 (see FIG. 1C and FIG. 1D). This arrangement allows baseplate 138 to move freely, guided by the fiducial retaining guides 137. We shall return to this arrangement when discussing the closing of containers with container closures.

Figure 1D:
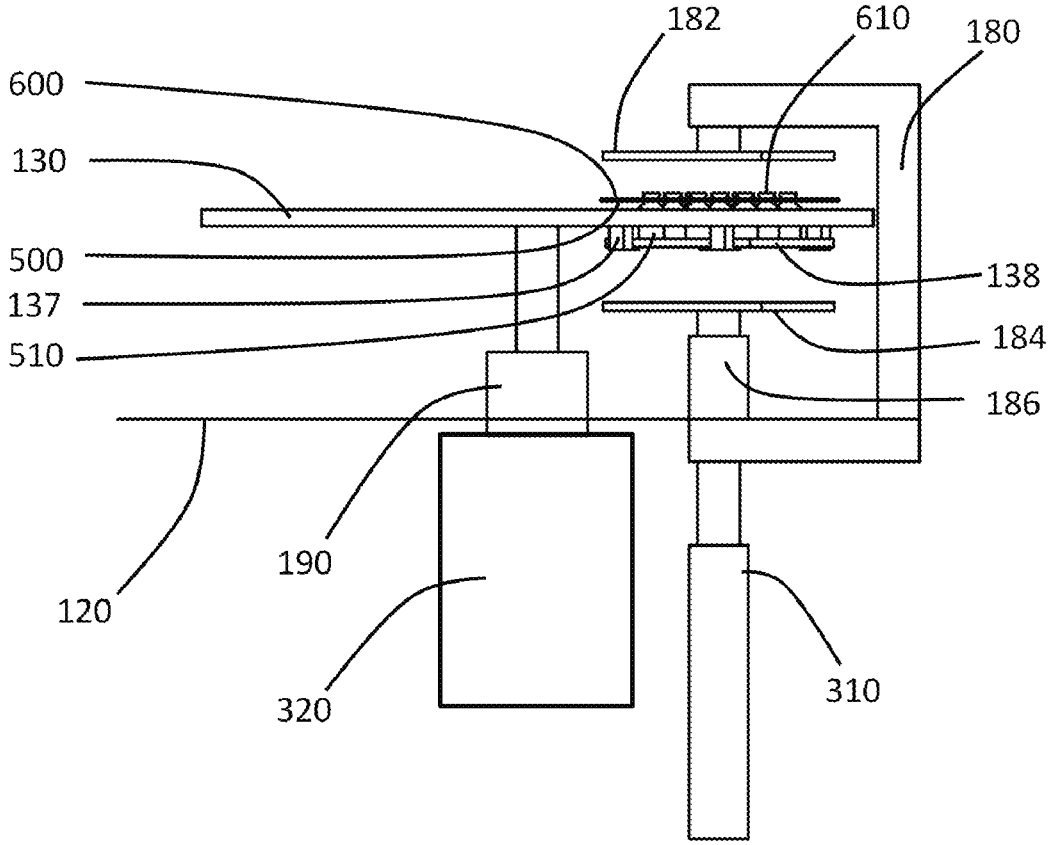
FIG. 1D shows a side view of a portion of the apparatus of FIG. 1A and FIG. 1B.
Figure 1E:
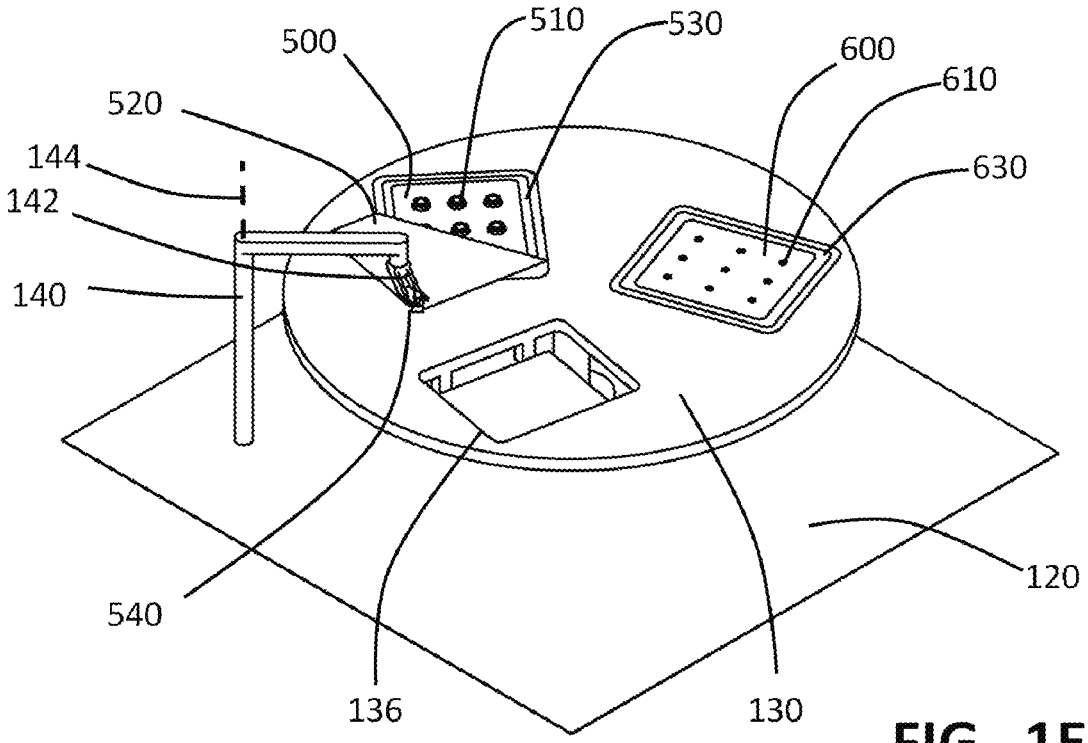
FIG. 1E shows a pharmaceutical container tub cover seated in the rotary stage of FIG. 1A to FIG. 1D being removed.

FIG. 1E shows fiducial locating opening 136 as empty, while a cover 520 is being peeled from container tub 530 in fiducial locating opening 132 (not visible) to expose nest 500 bearing pharmaceutical containers 510. At this point in the operation of system 1000, a cover similar to cover 520 has already been pealed from tub 630 in fiducial locating opening 134 (not visible) to expose nest 600 bearing container closures 610. FIG. 1G shows a close-up detailed view of the peeling of cover 520. Cover removal station 140 is rotatable about cover removal station rotation axis 144 parallel to rotary stage rotation axis 131 and comprises an engagement tool 142, which, in this particular embodiment, is fork-shaped in order to engage with a cover removal fixture 540 attached to cover 520. Cover removal fixture 540 is pre-attached to cover 520 before tub 530 is transferred into system 1000 via door 102 (See FIG. 1A). In the embodiment shown in FIG. 1E and FIG. 1G, cover removal fixture 540 is clipped to cover 520 and has a ball-shaped appendage to allow it to be engaged by engagement tool 142. Other combinations of cover removal fixtures and engagement tools are contemplated and system 1000 is not limited to the particular combination of cover removal fixture and engagement tool shown in FIG. 1A, FIG. 1E and FIG. 1G. Cover removal fixture 540, for example, may be manufactured as an integral or even monolithic part of cover 520 for use in filling systems such as filling system 1000. Or it may be clipped to cover 520 during the placement into tub 530 of nests 500 bearing containers 530 and during the placement into tub 630 of nests 600 bearing container closures 610.

Rotary stage 130 may be lowered to assist in obtaining a less acute angle between cover 520 and tub 530. Too acute an angle can lead to the tearing of cover 520. Cover removal station 140 can be rotated while rotary stage 130 rotates so that the combined motions of cover removal station 140 and rotary stage 130 provide a low stress path for the removal of cover 520, thereby limiting the chances of tearing of cover 520. In particular, cover removal station 140 may be rotated to ensure that engagement tool 142 is not present above fiducial locating opening 132 when container tub 530 is placed in or removed from fiducial locating opening 132.

In some embodiments, system 1000 comprises a single cover removal station 140 for sequentially removing covers from tubs 520 and 620. In other embodiments, system 1000 may be equipped with two or more cover removal stations 140 for dedicated removal of covers from tubs 520 and 620 and other additional tubs. In some embodiments covers are simultaneously removed from tubs 520 and 620 and from other tubs, all the removal processes benefiting from a single rotary motion of rotary stage 130.

Figure 1F:
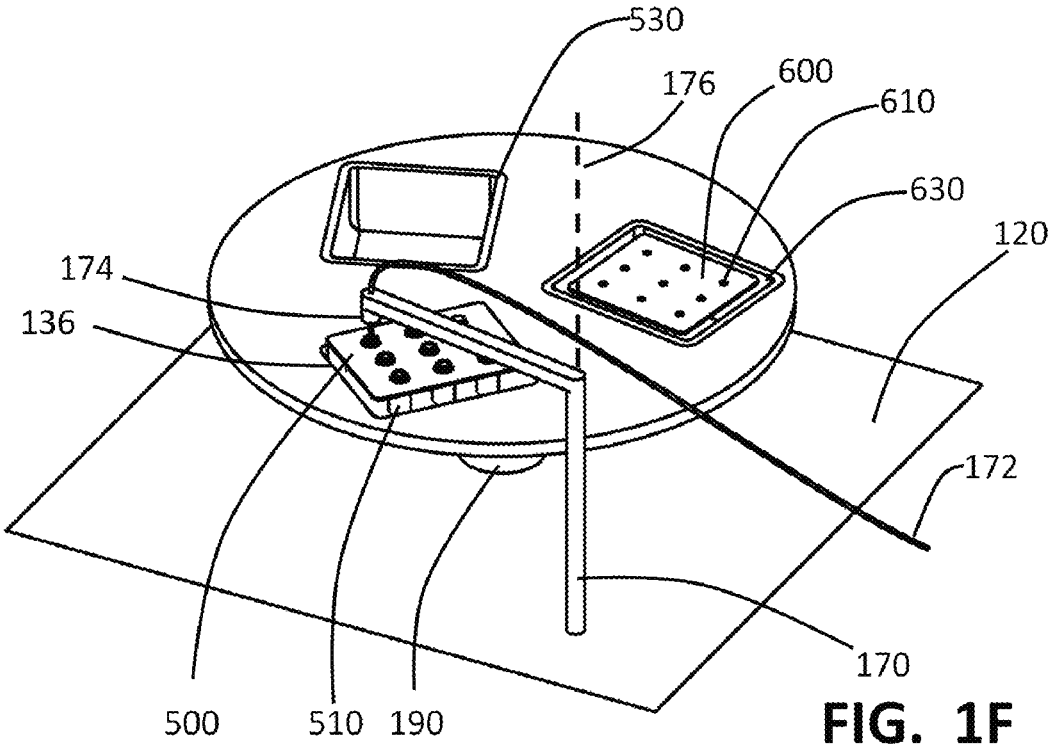
FIG. 1F shows pharmaceutical containers being filled with a pharmaceutical fluid substance in the apparatus of FIG. 1A to FIG. 1E.
Figure 1G:
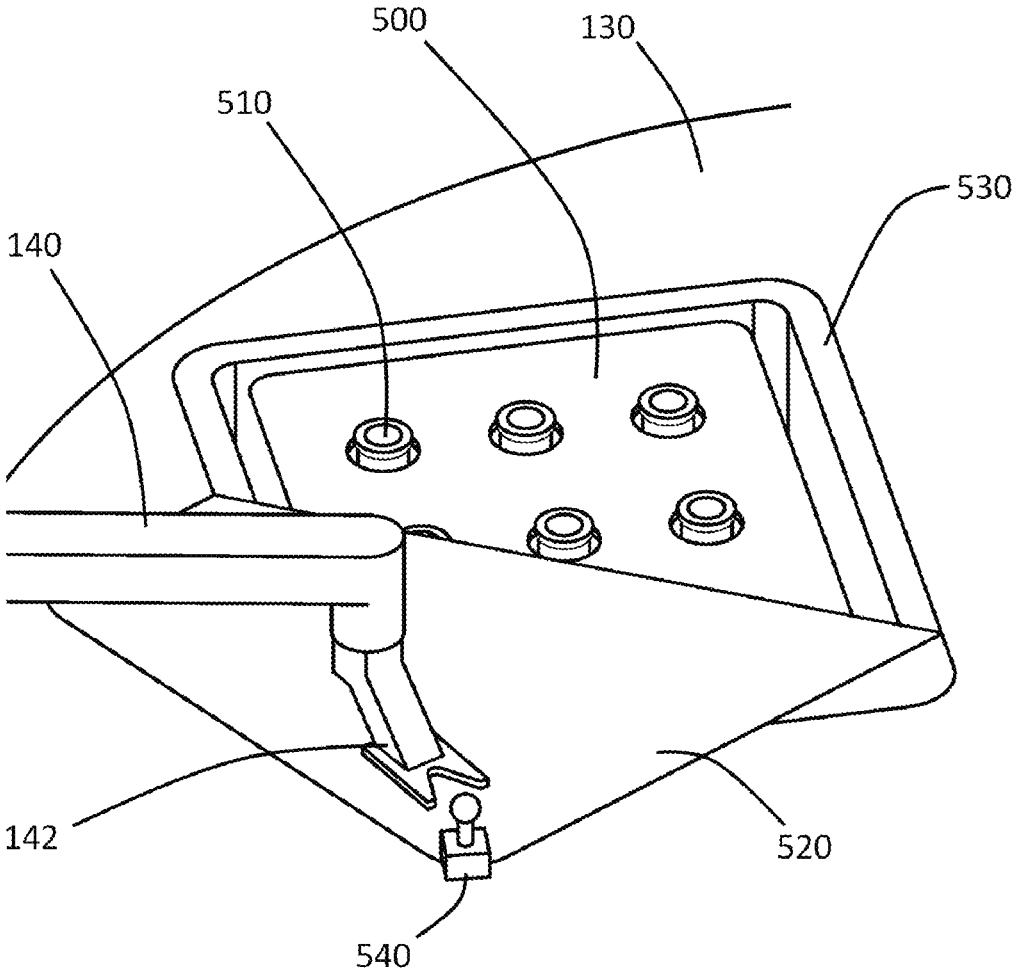
FIG. 1G provides a more detailed view of the cover removal components of the apparatus of FIG. 1A, FIG. 1B and FIG. 1E.

In FIG. 1A, FIG. 1B, and FIG. 1F a filling station 170 for filling pharmaceutical containers 510 with pharmaceutical fluid product comprises pharmaceutical fluid product feed line 172 supplying pharmaceutical fluid product to a pharmaceutical fluid product dispenser head 174 (See FIG. 1F). Filling station 170 is rotatable about filling station rotation axis 176 parallel to rotary stage rotation axis 131. Filling station 170 and rotary stage 130 can simultaneously or sequentially rotate to place dispenser head 174 over an opening of any selected container 510 in nest 500 when nest 500 is seated in fiducial locating opening 136. This allows every container 510 in nest 500 to be filled with pharmaceutical fluid product by product dispenser head 174. When not engaged in filling containers 510, filling station 170 may be rotated to swing dispenser head 174 completely away from fiducial locating opening 136, thereby allowing nests 600 bearing container closures 610 to be placed on top of nest 500 with a closure 610 directly on top of an opening of every container 510 residing in fiducial locating opening 136.

Another term employed to describe dispenser head 174 is "filling needle". Suitable filling needles and protective sheathing arrangements for such filling needles are described in co-pending U.S. patent application Ser. Nos. 14/890,223 and 15/199,771, the specifications of which are hereby incorporated in full.

FIG. 1A and FIG. 1B show two vacuum pickup systems 150 and 160, each respectively comprising a plurality of suction cups 152 and 162 (See FIG. 1B). Vacuum pickup system 150 is arranged to pick up nests 500 of containers 510 by means of suction cups 152, and vacuum pickup system 160 is arranged to pick up nests 600 of containers 610 by means of suction cups 162. Vacuum pickup system 160 may be raised and lowered in order to allow suction cups 162 to engage with different nests 600 of container closures 610 contained at differing depths inside tub 630. To this end, vacuum pickup system 160 may comprise a bellows feed-through allowing vertical motion whilst maintaining the aseptic integrity of chamber 100. Suitable vacuum pumps, or vacuum lines from a vacuum source external to system 1000, may be connected to vacuum pickup systems 150 and 160, and ensure suitable vacuum at the suction cups 152 and 162.

Cameras 210 and 220 are disposed to view and record the positioning of suction cups 152 and 162 on nests 500 and 600 respectively. In the embodiment shown in FIG. 1A, cameras 210 and 220 are disposed within chamber 200 and view nests 500 and 600 through sealed windows 112 and 122 respectively. In other embodiments, cameras 210 and 220 may be disposed within chamber 100 and view nests directly from within chamber 100.

Container closing ram system 180, shown in FIG. 1A, FIG. 1B, and FIG. 1D, comprises upper ram plate 182 disposed within chamber 100 above rotary stage 130, lower ram plate 184 disposed within chamber 100 below rotary stage 130, and ram drive 310 within chamber 300. Ram drive 310 is disposed for driving lower ram plate 184 vertically toward upper ram plate 182 via bellows feed-through 186. Loose base plate 138 of fiducial locating opening 136, when located above lower ram plate 184 by suitably rotating rotary stage 130, is pushed upward by ram plate 184 and is guided in the process by the fiducial retaining guides 137 (See FIG. 1D). When the closures 610 in closure nest 600 are ultimately pushed against upper ram plate 182, they are forced into the openings of the containers 510 in nest 500. This creates a sandwiched nest of closed containers 510, each closed by a corresponding closure 610. As shown in FIG. 1D, nests 500 and 600 are forced together in the process to create a compound nest 500/600.

Controller 400, shown in FIG. 1A and FIG. 1B, may communicate with the rest of system 1000 via control communications line 410, or may be contained physically within system 1000, for example, within chamber 200. Controller 400 may have suitable memory and a processor contain suitable software programming instructions which, when loaded in the memory executed by the processor, control the motions of ram system 180, vertical motion and rotating action of rotary stage 130, the application of vacuum to vacuum pickup systems 150 and 160, the imaging by cameras 210 and 220, the vertical motion of vacuum pickup system 160, any rotational or vertical motions required from cover removal stations 140 and filling station 170, as well as the on-and-off valving of the pharmaceutical fluid product supply to dispenser head 174. Suitable valves and pumps, typically peristaltic pumps, required for the pharmaceutical fluid product supply to dispenser head 174 are well known in the art and may be housed in chamber 200 or may be located outside system 1000. The various mechanical drives for the subsystems described above are well-known in the art, will not be discussed here in detail. These may typically be housed in chamber 200 of system 1000. The software, when executed by the processor, instructs the rotary stage to rotate to angular positions that are either predetermined or based on image information from the cameras and controls the cover removal stations, the filling station, the vacuum pickup systems, and the ram system to operate specifically in conjunction with the rotary stage.

Figure 2A:
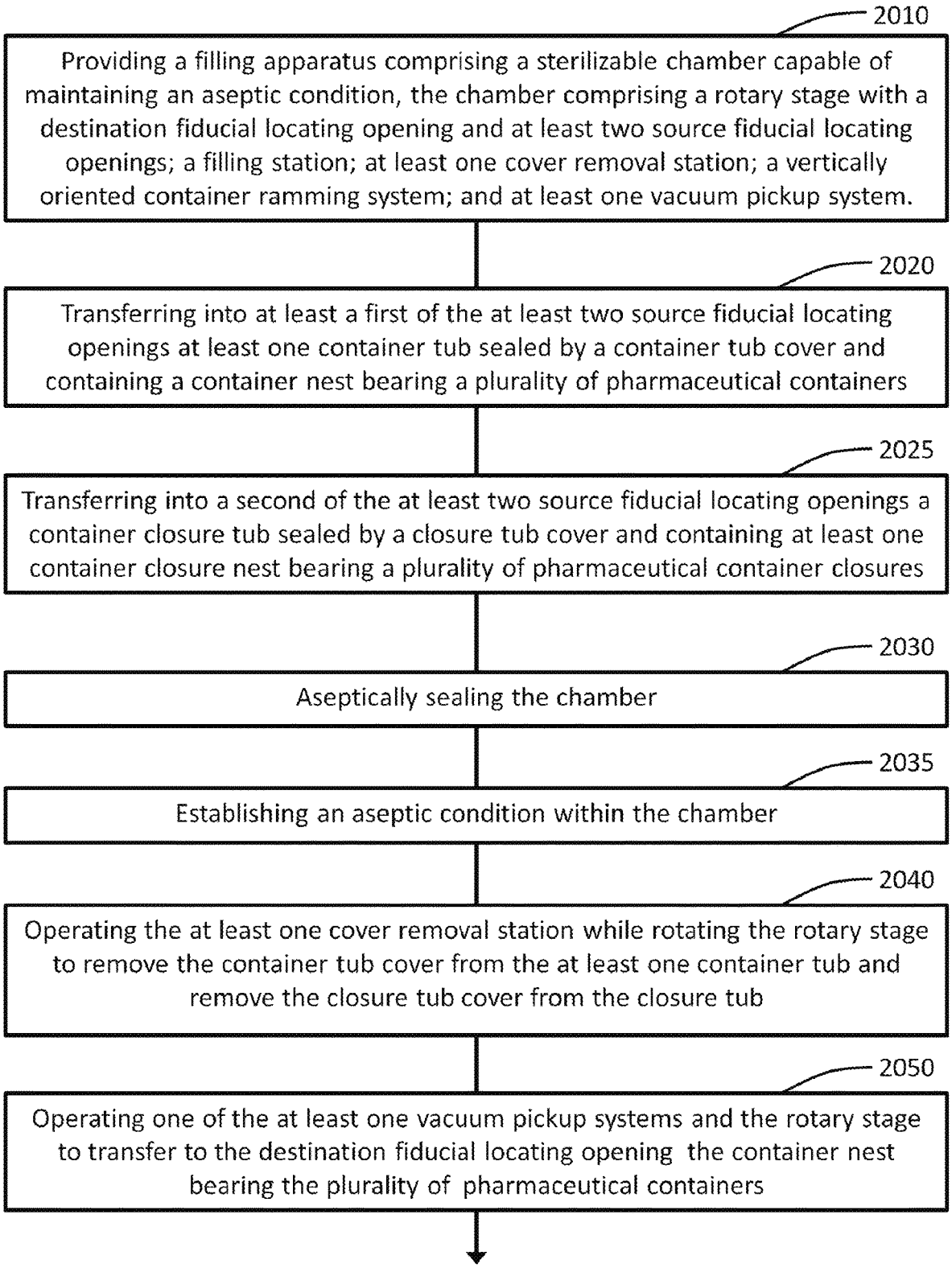
FIG. 2A and FIG. 2B jointly form a drawing of a flow chart for a method of aseptically filling pharmaceutical containers with a pharmaceutical fluid substance in a spatially constrained environment.
Figure 2B:
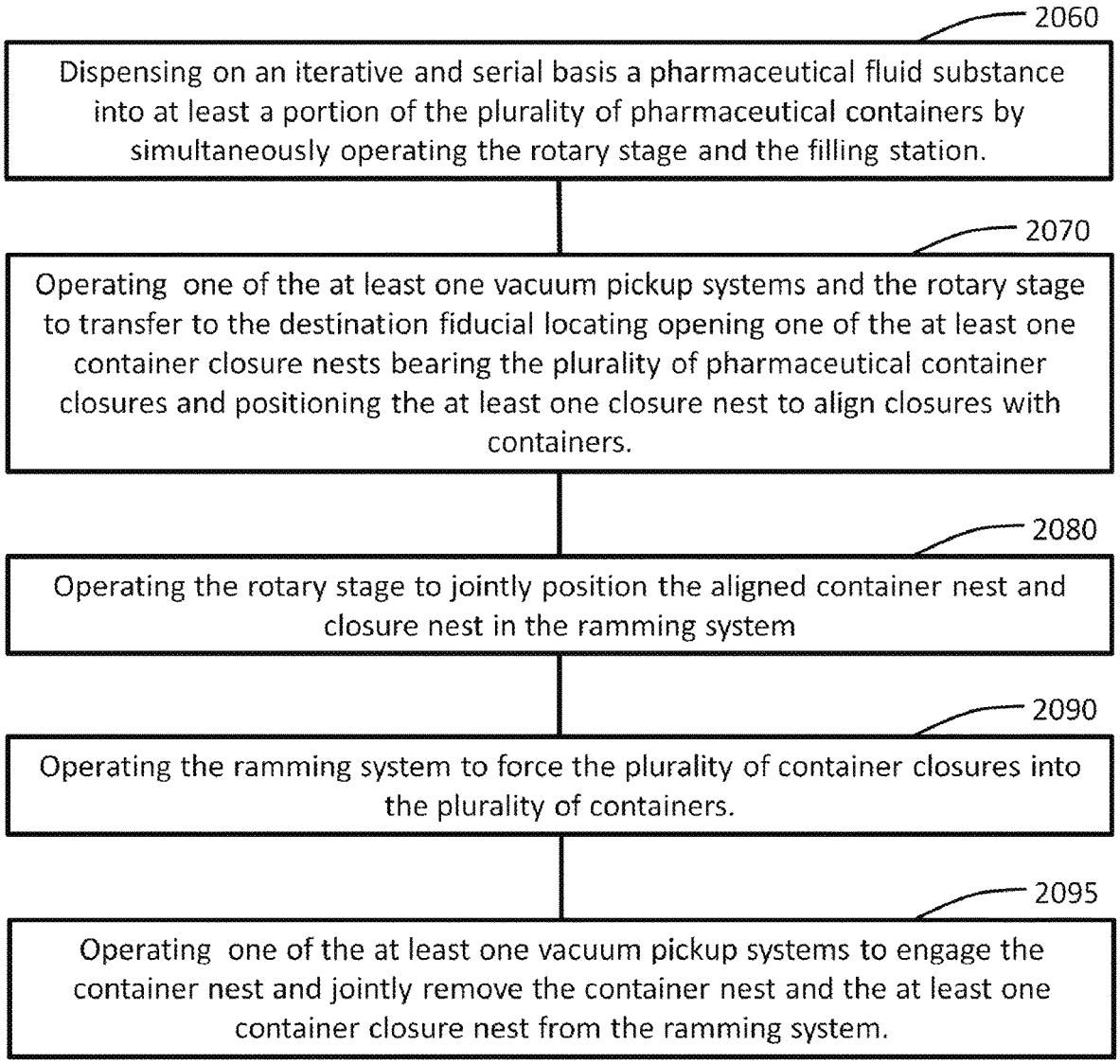

A method based on system 1000 for filling nested pharmaceutical containers with a pharmaceutical fluid product will now be described at the hand of the flow chart given in FIG. 2A, and which is continued in FIG. 2B. The method comprises providing [2010] a filling apparatus 1000 comprising a sterilizable chamber 100 capable of maintaining an aseptic condition, the chamber comprising a rotary stage 130 with a destination fiducial locating opening 136 and at least two source fiducial locating openings (132 and 134); a filling station 170; at least one cover removal station 140; a vertically oriented container ramming system 180; and at least one vacuum pickup system (for example 150 and/or 160). The method further comprises transferring [2020] into at least a first of the at least two source fiducial locating openings (132 and 134) at least one container tub 530 sealed by a container tub cover 520 and containing a container nest 500 bearing a plurality of pharmaceutical containers 510; and transferring [2025] into a second of the at least two source fiducial locating openings (134 and 132) a container closure tub 630 sealed by a closure tub cover and containing at least one container closure nest 600 bearing a plurality of pharmaceutical container closures 610.

The method further comprises aseptically sealing [2030] the chamber 100 and establishing [2035] an aseptic condition within the chamber 100. The establishing [2035] an aseptic condition within the chamber 100 may comprise treating the interior of chamber 100 with any one or more of steam, hydrogen peroxide vapor, ozone, nitrogen dioxide, and ethylene oxide.

The method further comprises operating [2040] the at least one cover removal station 140 and rotating the rotary stage 130 to remove the container tub cover 520 from the at least one container tub 530 and remove the closure tub cover from the closure tub 630; operating [2050] the rotary stage 130 and one of the at least one vacuum pickup systems (for example 150 and/or 160) to transfer to the destination fiducial locating opening 136 the container nest 500 bearing the plurality of pharmaceutical containers 510; and dispensing [2060] on an iterative and serial basis a pharmaceutical fluid substance into at least a portion of the plurality of pharmaceutical containers 510 by operating the rotary stage 130 and the filling station 170. The phrase "iterative and serial" is employed in this specification to describe the fact that the same operational steps are repeatedly used to fill the various containers and the fact that the containers are filled one after another, as opposed to simultaneously. In some embodiments multiple containers may be simultaneously filled using a filling station with multiple dispenser heads.

Steps [2040], [2050], and [2060] each involves rotating the rotary stage 130 and operating another device, being respectively the cover removal station 140, one of the at least one vacuum pickup systems (for example 150 and/or 160), and the filling station 170. The motions involved may be simultaneous in some cases or embodiments, and serial in other cases or embodiments. In some embodiments some of the motions may be simultaneous and others may be serial.

The operating [2040] the at least one cover removal station 140 may comprise engaging an engagement tool (for example tool 142) with a cover removal fixture (for example fixture 540) pre-attached to the cover being removed. Operating [2050] one of the at least one vacuum pickup systems may comprise contacting the container nest 500 with a plurality of suction cups 152 while applying a vacuum to the suction cups 152. The dispensing [2060] a pharmaceutical fluid substance into at least a portion of the plurality of pharmaceutical containers may comprise disposing on an iterative and serial basis a fluid product dispenser head 174 of the filling station 170 over the openings of the at least a portion of the plurality of pharmaceutical containers 510. The operating [2050] the rotary stage 130 and one of the at least one vacuum pickup systems may comprise operating a camera 210 to obtain image information of the container nest 500 bearing the plurality of pharmaceutical containers 510 and to position the one of the at least one vacuum pickup systems over the container nest 500.

The method further comprises operating [2070] one of the at least one vacuum pickup systems (for example 150 and/or 160) and the rotary stage 130 to transfer to the destination fiducial locating opening 136 one of the at least one container closure nests 600 bearing the plurality of pharmaceutical container closures 610 and positioning the at least one closure nest 600 to align closures 610 with containers 510; operating [2080] the rotary stage 130 to jointly position the aligned container nest 500 and closure nest 600 in the ramming system 180; and operating [2090] the ramming system 180 to force the plurality of container closures 610 into the plurality of containers 510.

Operating [2070] one of the at least one vacuum pickup systems may comprise contacting the container closure nest 600 with a plurality of suction cups 162 while applying a vacuum to the suction cups 162. Operating [2090] the ramming system 180 may comprise driving the plurality of pharmaceutical containers 510 toward an upper ram plate 182 of the ramming system 180.

The operating [2070] the rotary stage 130 and one of the at least one vacuum pickup systems may comprise operating a camera 220 to obtain image information of the one of the at least one container closure nests 600 bearing the plurality of pharmaceutical container closures 610 and to position the one of the at least one vacuum pickup systems over the one of the at least one container closure nests 600.

The providing [2010] a filling apparatus may comprise providing a filling apparatus further comprising a controller 400 and a software program executable by controller 400. Any one or more of the aseptically sealing [2030] the chamber 100; establishing [2035] an aseptic condition within the chamber 100; operating the rotary stage 130; operating the at least one cover removal station 140; operating [2070] one of the at least one vacuum pickup systems (150 and/or 160); operating the filling station 170; and operating [2090] the ramming system 180 may be done automatically by executing the software program in the controller.

In the embodiment described at the hand of FIGS. 1A to 1F, each of steps [2040], [2050], [2060], [2070], and [2080] comprises rotating a rotary stage, for example rotary stage 130, bearing the container nests and container closure nests.

In other embodiments a plurality of the steps of removing a container tub cover from at least one container tub 530; removing a container tub cover from at least one container closure tub 630; transferring to the destination fiducial locating opening 136 the container nest 500; dispensing a pharmaceutical fluid substance into pharmaceutical containers 510; transferring to the destination fiducial locating opening 136 one of the at least one container closure nests 600; and positioning the aligned container nest 500 and closure nest 600 in the ramming system 180 comprises rotating a rotary stage bearing the container nests and container closure nests.

In a general embodiment, at least one of the steps of removing a container tub cover from at least one container tub 530; removing a container tub cover from at least one container closure tub 630; transferring to the destination fiducial locating opening 136 the container nest 500; dispensing a pharmaceutical fluid substance into pharmaceutical containers 510; transferring to the destination fiducial locating opening 136 one of the at least one container closure nests 600; and positioning the aligned container nest 500 and closure nest 600 in the ramming system 180 comprises rotating a rotary stage bearing the container nests and container closure nests.

It is to be noted that neither filling system 1000, nor the associated method, needs to employ the vibratory bowls or escapements that are typical of the prior art. Unlike many prior art systems, filling system 1000 also does not require the use of gloves for use by the operator to access the interior of the chamber.

The system above has been described as employing a controller that runs stored software running on a general-purpose computer platform, but it could also be implemented in whole or in part using special-purpose hardware.

The system described above also employs fiducial openings defined in the rotary stage to hold the tubs and nests, but it could also employ other types of fiducial structures that include other configurations of constraining surfaces sufficient to hold the tubs and nests in place. Notched posts mounted on the rotary stage could hold the tubs and/or nests above the rotary stage, for example.

Figure 3A:
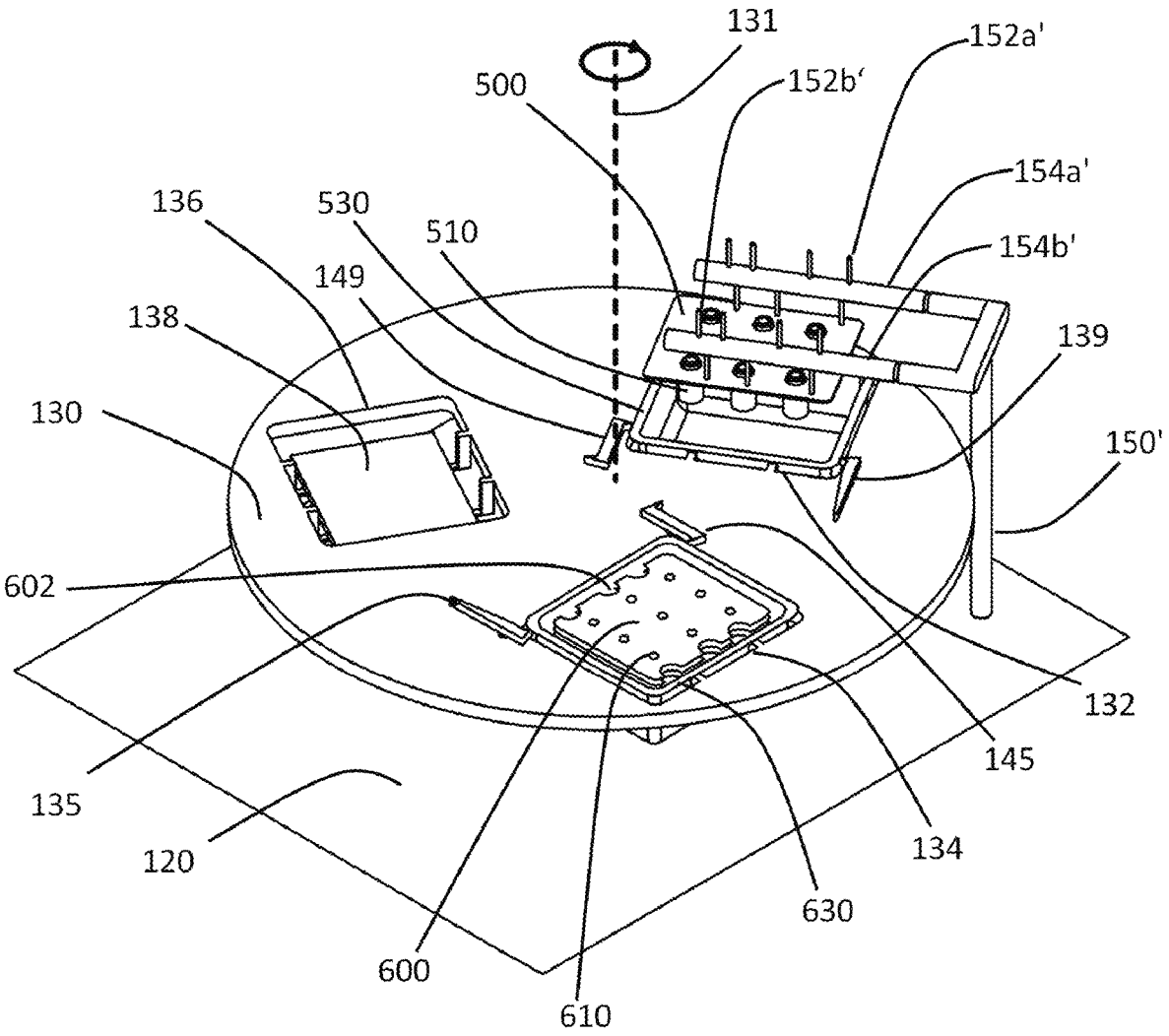
FIG. 3A is a drawing of subsystems of another embodiment of an apparatus for filling pharmaceutical containers with a pharmaceutical fluid product.
Figure 3B:
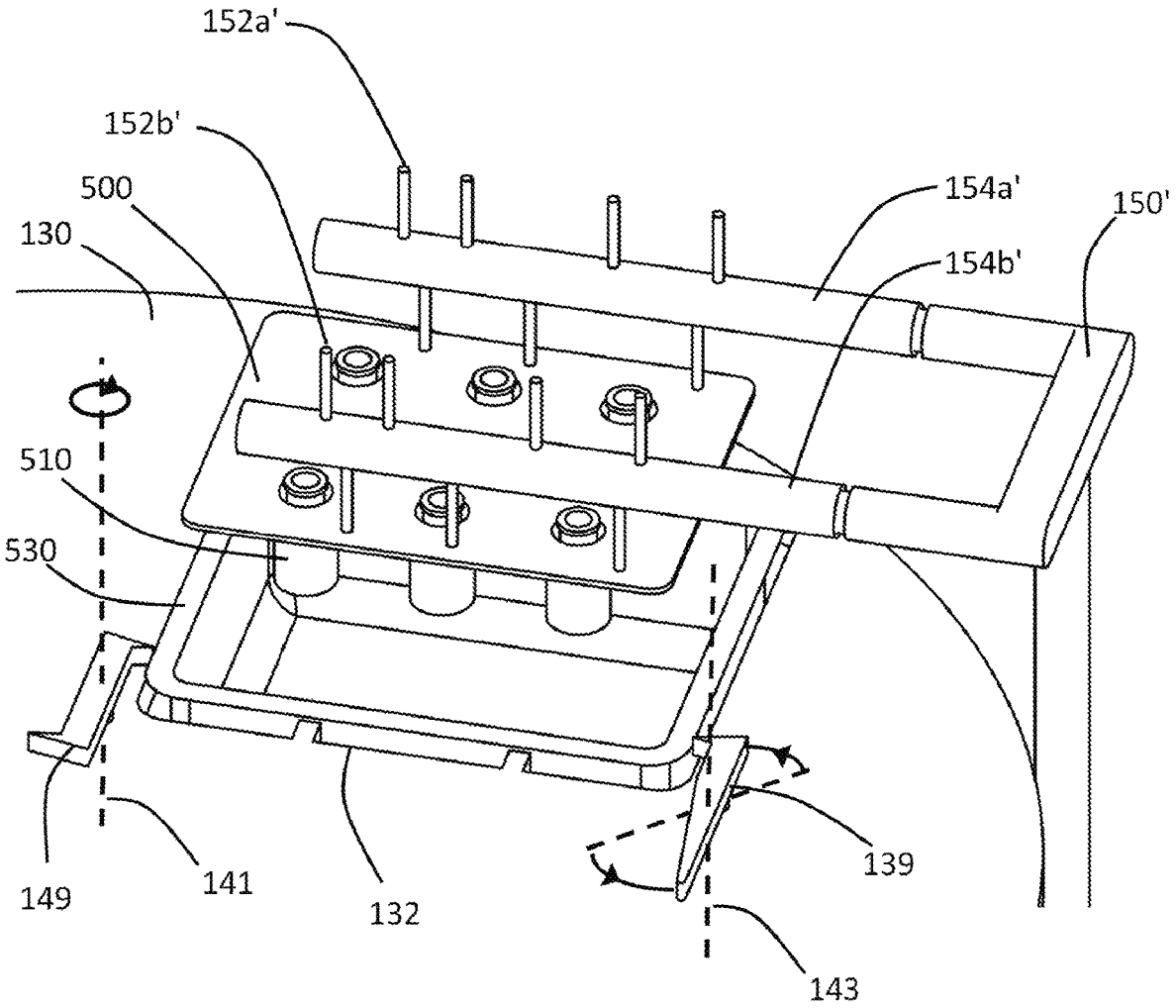
FIG. 3B shows a portion of FIG. 3A in more detail.

Another embodiment of a filling system according to the invention may be in all respects identical to the embodiments described above at the hand of FIGS. 1A and 1B, with the exception of the vacuum pickup system(s) 150 or 160. FIGS. 3A and 3B show a portion of a filling system as described above. FIG. 3B, in particular, focuses on the general area of one of the vacuum pickup systems, by way of example, vacuum pickup system 150. In this alternative embodiment, vacuum pickup system 150 is replaced by reconfigurable vacuum pickup system 150'. Vacuum pickup system 160 of FIGS. 1A and 1B may similarly be replaced by a reconfigurable vacuum pickup system 160' of the same arrangement as vacuum pickup system 150'. In the interest of clarity, vacuum pickup system 160' is not shown in FIG. 3A or 3B. In other embodiments, a single reconfigurable vacuum pickup system 150' may be employed to pick up both container nests and container closure nests. Vacuum pickup system 150' may access the container nests and container closure nests by rotation of rotary stage 130.

Vacuum pickup system 150' comprises two rotary arms 154*a*' and 154*b*', in their turn respectively comprising pluralities of suction cups 152*a*' and 152*b*'. Vacuum pickup system 150' is arranged to pick up nests 500 of containers 510 by means of suction cups 152*a*' and 152*b*'. Vacuum pickup system 150' may also be arranged to pick up nests 600 of container closures 610 by means of suction cups 152*a*' and 152*b*'. As with vacuum pickup system 150, vacuum pickup system 150' may be raised and lowered in order to allow suction cups 152*a*' and 152*b*' to engage with different nests 600 of container closures 610 contained at differing depths inside tub 630.

Suction cups 152*a*' and 152*b*' are arranged on rotary arms 154*a*' and 154*b*' as pluralities of sets of linearly arranged suction cups 152*a*' and 152*b*', each set of linearly arranged suction cups 152*a*' and 152*b*' being arranged at a different angle perpendicular to the longitudinal axes of rotary arms 154*a*' and 154*b*'. This arrangement allows rotary arms 154*a*' and 154*b*' to be rotated about their longitudinal axes in order to orient different sets of linearly arranged suction cups 152*a*' and 152*b*' to engage with different nests 500 of containers 510. This allows the sets of suction cups 152*a*' and 152*b*' to be individually selectable for use. Rotation of rotary arms 154*a*' and 154*b*' may be performed manually. In other embodiments, rotation of rotary arms 154*a*' and 154*b*' may be by means of a suitable motorized drive incorporated in vacuum pickup system 150' and controlled by controller 400 shown in FIG. 1A.

By selecting different sets of linearly arranged suction cups 152*a*' and 152*b*' via the rotation of rotary arms 154*a*' and 154*b*', the sets of suction cups 152*a*' and 152*b*' may be disposed to engage with different container nests 500 bearing containers 510, or container closure nests 600 bearing container closures 610.

FIGS. 3A and 3B show vacuum pickup system 150' as comprising two rotary arms, being rotary arms 154*a*' and 154*b*'. In other embodiments, one or more arms may be employed, all embodiments sharing the concept of a selectable configuration of suction cups. Whereas the selection of suction cup configurations in FIG. 3A and FIG. 3B is by means of rotation of the arms 154*a*' and 154*b*' bearing the suction cups 152*a*' and 152*b*', the selecting in other embodiments may be on a different basis of configuration, including, for example without limitation, lateral translation of suction-cup-bearing arms in a plane parallel to the rotation plane of rotary stage 130 in order to engage different sets of suction cups with container nests or container closure nests. In FIGS. 3A and 3B suction cups are arranged in linear sets. In other embodiments non-linear arrangements of suction cups may be employed.

Turning now to FIG. 3B specifically, we consider members 149 and 139 in more detail. In one embodiment, reconfigurable stopping member 149 is shown as having two different ends of which a first end may be selected for use by suitable rotation of reconfigurable stopping member 149 about stopping member rotation axis 141 to a predetermined set position. In the set position, reconfigurable stopping member 149 provides a hard stop for a proximal end of container 530 against the selected end of reconfigurable stopping member 149 along a direction parallel to the longitudinal axes of rotary arms 154*a*' and 154*b*'. In this embodiment, reconfigurable stopping member 149 may be rotated through 180 degrees to dispose the second end of reconfigurable stopping member 149 to stop container 530. The second end of reconfigurable stopping member 149 may be configured to stop the proximal end of container 530 at a different point than where the first end of reconfigurable stopping member 149 stops the proximal end of container 530

Restraining member 139 is configured to push against a distal end of container 530. While different means are contemplated to ensure the pushing action of restraining member 139, one particular suitable means is by providing restraining member 139 with suitable spring loading to rotate about axis 143. By the above operation, reconfigurable stopping member 149 and restraining member 139 together allow container 530 to be positioned at an exact location parallel to the longitudinal axes of rotary arms 154*a*' and 154*b*'. The particular exact location is selectable by selecting the appropriate end of reconfigurable stopping member 149 to stop container 530. This arrangement allows containers 530 of different dimensions parallel to the longitudinal axes of rotary arms 154*a*' and 154*b*' to be located at exact predetermined locations with respect to sets of suction cups 152*a*' and 152*b*'.

A particular set of suction cups 152*a*' and 152*b*' may be selected to match the selection of the particular end of reconfigurable stopping member 149. In this way, vacuum pickup system 150' may be set to a configuration that ensures that a selected size of container 530 is precisely positioned to allow container nests 500 within container 530 to be engaged by specific sets of suction cups 152*a*' and 152*b*'. Vacuum pickup system 150' is thereby reconfigurable to engage with nests of different sizes within containers of different sizes.

In the interest of clarity, the description above, as well as FIGS. 3A and 3B, show an arrangement that allows for the exact positioning of containers 530 along only one dimension in the rotation plane of rotary stage 130, the dimension of the containers perpendicular to the one dimension being assumed to be identical. In such an arrangement, fiducial locating openings 132 and 134 are sized to constrain containers 530 in the perpendicular dimension in the rotation plane of rotary stage 130.

In another embodiment, a further reconfigurable stopping member and restraining member may be added to the arrangement of FIG. 3A and FIG. 3B in order to address the positioning of container 530 in the perpendicular direction within the rotation plane of rotary stage 130. To allow the positioning of container 530 in this perpendicular direction, fiducial locating openings 132 and 134 are not sized to constrain containers in any direction within the rotation plane of rotary stage 130.

In the embodiments described above, reconfigurable stopping member 149 has been described as having two ends of which one is selected for use at any one time by rotating reconfigurable stopping member 149 about stopping member rotation axis 141. In other embodiments, reconfigurable stopping member 149 may be shaped or configured to have more than two stopping ends, the ends being selectable by suitable rotation of reconfigurable stopping member 149 about stopping member rotation axis 141. In one embodiment, in which the reconfigurable stopping member has a very large number of stopping ends, the reconfigurable stopping member may assume the shape of a cam, representing a large plurality of possible stopping ends that may be selected via rotation of the reconfigurable stopping member about a suitable stopping member rotation axis.

In general, the system described at the hand of FIGS. 3A and 3B comprises a reconfigurable fiducial nest positioning system. The reconfigurable fiducial nest positioning system comprises a movable platform comprising fiducial locating opening 132, reconfigurable stopping member 149, and restraining member 139. In the case of the system of FIGS. 3A and 3B, the movable platform is rotary stage 130. As explained later, other movable platforms are also contemplated. To the extent that, for example, tub 530 positionally constrains and locates nest 500 inside tub 530, any system that fiducially locates tub 530 inherently also fiducially locates nest 500.

The various embodiments contemplated all comprise a reconfigurable vacuum pickup system that may be configured to engage its suction cups with corresponding areas on a pharmaceutical container nest. The containers in the container nest may be closed by corresponding container closures suspended in a container closure nest. The planar surface of the container closure nest may have an outline that leaves pass-throughs on its perimeter for the suction cups to pass through to engage with the container nest. By way of example, in FIG. 3*a* pass-throughs 602 are shown on the perimeter of closure nest 600. Alternatively or additionally, the container closure nest may have suitable openings in its planar interior to serve as pass-throughs for the suction cups to pass through to engage with the container nest. The vacuum pickup systems contemplated are further configured and disposed to pick up the combination of nested containers and their closures by the container nest, as opposed to by the closure nest.

In a general embodiment, a nest handling subsystem comprises a reconfigurable vacuum pickup system for picking up container nests and/or container closure nests may comprise one or more arms bearing a plurality of sets of suction cups. By reconfiguration of the vacuum pickup system a set of suction cups may be selected from among the plurality of sets of suction cups, the selected set of suction cups being pre-arranged to engage with a particular container nest or container closure nest. The selection may be on the basis of one or both of the size and the shape of the nest. The nest handling system may further comprise at least one pair of a reconfigurable stopping member 149 and a restraining member 139 disposed proximate opposing ends of a fiducial locating opening 132 for holding a tub 530 containing container nests 500 bearing containers 510 in order to engage with opposing ends of the tub 530. The stopping and restraining members are disposed to position tub 530 in a predetermined position that ensures that the selected set of suction cups can engage with the container nests and/or container closure nests.

As is the case with opening 132, opening 134 of FIG. 3A may also be served by at least one set of a reconfigurable stopping member, being member 145 in this case, and a restraining member, being member 135 in this case. Reconfigurable stopping member 145 and a restraining member 135 function with respect any tub in opening 134 in the same way as reconfigurable stopping member 149 and a restraining member 139 function with respect any tub in opening 132.

The various embodiments above have been described in terms of FIG. 1A to E and FIG. 3A, and FIG. 3B in which the vacuum pickup system 150, 160 is described as part of a pharmaceutical filling system 1000. However, vacuum pickup system 150', 160' may also be employed in its own right other apparatus not limited to the filling system of FIG. 1A to 1E, or, in fact, to filling systems in general. Some other example applications include, without limitation, lyophilizing systems. It may be applied to suitable nests of any objects arranged in a predetermined pattern. Furthermore, while the system 1000 of FIG. 1A to FIG. 1E employs a rotary stage 130, the reconfigurable vacuum pickup system 150' may employ any suitable movable platform comprising suitable fiducial locating openings.

The method described above at the hand of FIGS. 2A and 2B may now also be described in more detail with reference to FIG. 3A and FIG. 3B. The providing at least one vacuum pickup system as part of the providing a filling apparatus step [2010] may comprise providing at least one reconfigurable vacuum pickup system 150', the at least one reconfigurable vacuum pickup system 150' comprising a plurality of sets of suction cups 152*a*' and 152*b*'.

The providing a filling apparatus step [2010] may comprise providing a rotary stage 130 with a destination fiducial locating opening 136 and at least two source fiducial locating openings 132, 134, each source fiducial opening having at least one pair of a reconfigurable stopping member 149 and a restraining member 139.

The transferring step [2020] may comprise operating at least a first reconfigurable stopping member 149 to stop the container tub 530 at a predetermined container tub position and operating at least a first restraining member 139 to restrain the container tub 530 at the predetermined container tub position.

The transferring step [2025] may comprise operating at least a second reconfigurable stopping member 145 to stop the container closure tub 630 at a predetermined closure tub position and operating at least a second restraining member 135 to restrain the container tub 630 at the predetermined closure tub position.

The step of operating [2050] the at least one vacuum pickup system 150', 160' may comprise configuring the at least one reconfigurable vacuum pickup system 150', 160' to select a first predetermined set of suction cups disposed to engage with the container nest 500.

The operating [2070] of one of the at least one vacuum pickup system 150', 160' may comprise configuring the at least one reconfigurable vacuum pickup system 150', 160' to select a second predetermined set of suction cups disposed for engaging with the container closure nest 600.

The method may further comprise operating [2095] the at least one vacuum pickup system 150', 160' with the first predetermined set of suction cups selected to engage with the container nest 500 and jointly remove the container nest 500 and container closure nest 600 from the ramming system 180.

Figure 4A:
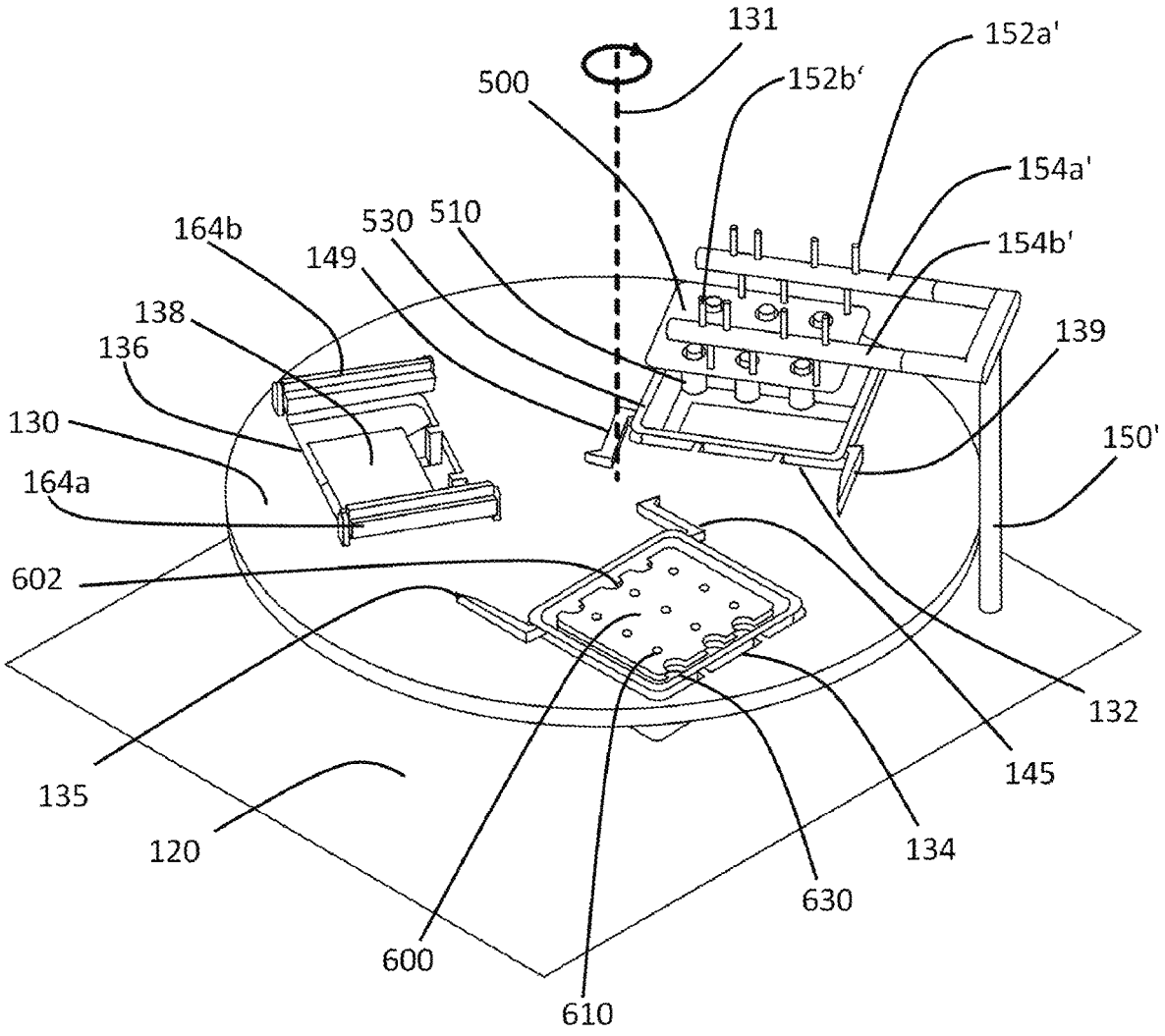
FIG. 4A is a drawing of subsystems of a further embodiment of an apparatus for filling pharmaceutical containers with a pharmaceutical fluid product.
Figure 4B:
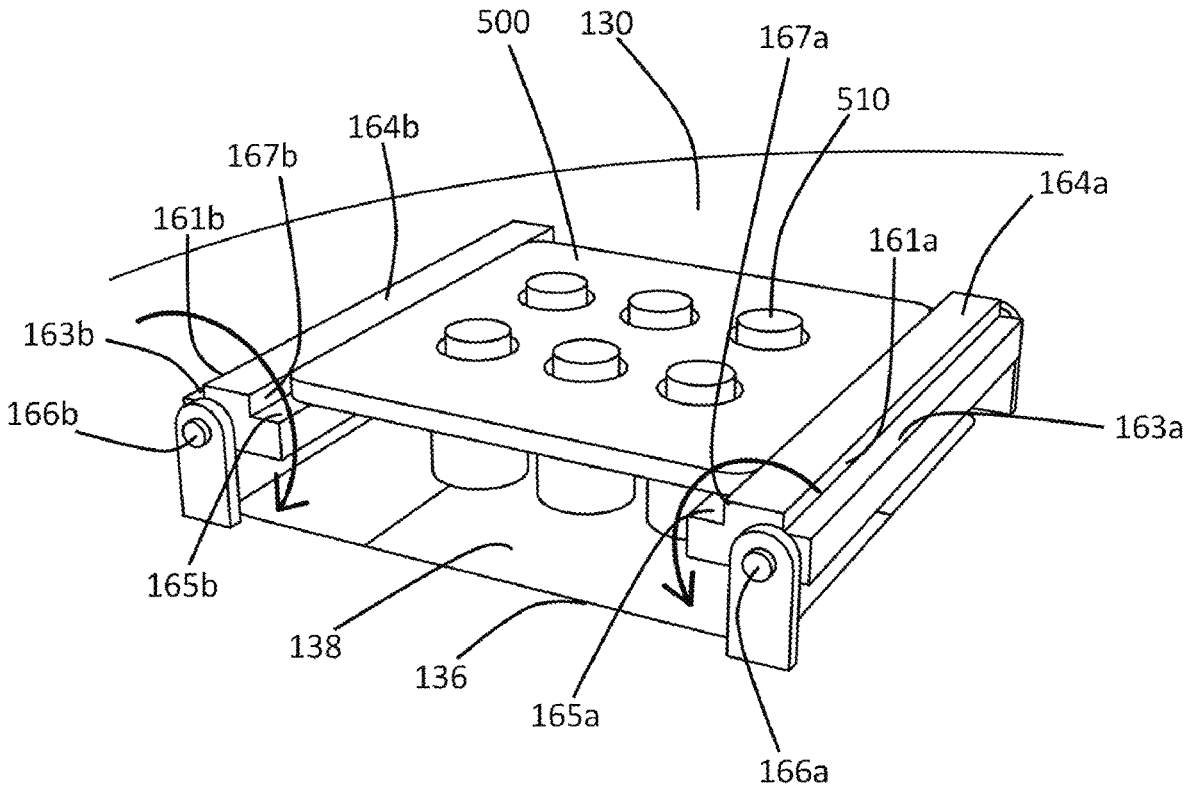
FIG. 4B shows a portion of FIG. 4A in more detail.

We have considered in FIG. 3A and FIG. 3B alternative embodiments of the arrangements of vacuum pickup systems 150 and 160 of FIG. 1*a* in the form of vacuum pickup systems 150' and 160'; and the positioning arrangements associated with source openings 132 and 134 in the form of elements 135,145,139, and 149. We now turn our attention to alternative embodiments for the arrangements around destination opening 136 of FIG. 1A and FIG. 3A. FIG. 4A and its close up view in FIG. 4B show the system of FIG. 3A with a different embodiment of the arrangement around destination opening 136. While cameras 210 and 220 of FIG. 1A may be employed in conjunction with controller 400 and rotation of rotary stage 130 to position nest 500 at opening 136, and to position nest 600 over nest 500 at opening 136, the adjustable destination fiducial positioning system of FIG. 4A and FIG. 4B comprising rotary positioning elements 164*a* and 164*b* may be alternatively or additionally employed to accurately position nests 600 and 500.

Typical industrial container nests are not manufactured to a dimensional standard, and, as a result, any system for filling and closing nested containers 510 has to have a means to accurately position differently sized nests 500 bearing the containers 510. To this end, rotary positioning elements 164*a* and 164*b* may have different sets of paired positioning surfaces 167*a*,167*b* and 163*a*,163*b* allowing nests 500 of specific dimensions to be accurately fitted between such paired positioning surfaces. In FIG. 4B, nest 500 fits such that its two opposing ends in a first dimension touch mutually facing surfaces 167*a* and 167*b* of rotary positioning elements 164*a* and 164*b* respectively. By mutually counter-rotating elements 164*a* and 164*b* about respectively axes 166*a* and 166*b*, surfaces 167*a* and 167*b* may be made to face each other and may thereby allow the precise positioning between them of a nest of different length in the first dimension.

As is evident from FIG. 4B, when surfaces 167*a* and 167*b* face each other, the nest positioned snugly between them may be retained in a precise and predetermined vertical position by resting on surfaces 165*a* and 165*b* of rotary positioning elements 164*a* and 164*b* respectively. When surfaces 163*a* and 163*b* face each other, the alternative nest positioned snugly between them may retained in a precise and predetermined vertical position by resting on surfaces 161*a* and 161*b* of rotary positioning elements 164*a* and 164*b* respectively. Elements 164*a* and 164*b* may be rotated manually about axes 166*a* and 166*b* respectively. In some embodiments, the rotation of elements 164*a* and 164*b* may be done automatically by means of motorized drives controlled by controller 400 and suitable control software. That control may be based on predetermined dimensional data relating to the nest being positioned between the surfaces of elements 164*a* and 164*b*. It may also be based on input data derived from imaging data obtained from cameras 210 and/or 220. Further, the rotation may take place as the nest 500 is lowered into position so that the particular surfaces of elements 164*a* and 164*b* destined to engage with the opposing ends of the nest 500 along the first dimension may serve as closing horizontal grip on nest 500 as the surfaces rotate toward the position in which they face each other. In this embodiment, the horizontal positioning and vertical positioning of a nest between elements 164*a* and 164*b* are not mutually independent.

Another arrangement as shown in FIG. 4A and FIG. 4B for the first dimension of the nest 500, may also be established for the second planar dimension of nest 500 perpendicular to the first dimension. This allows any nest 500 placed at opening 136 to be accurately located in a location predetermined by the choice of setting of rotary positioning elements 164*a* and 164*b*.

Figure 5A:
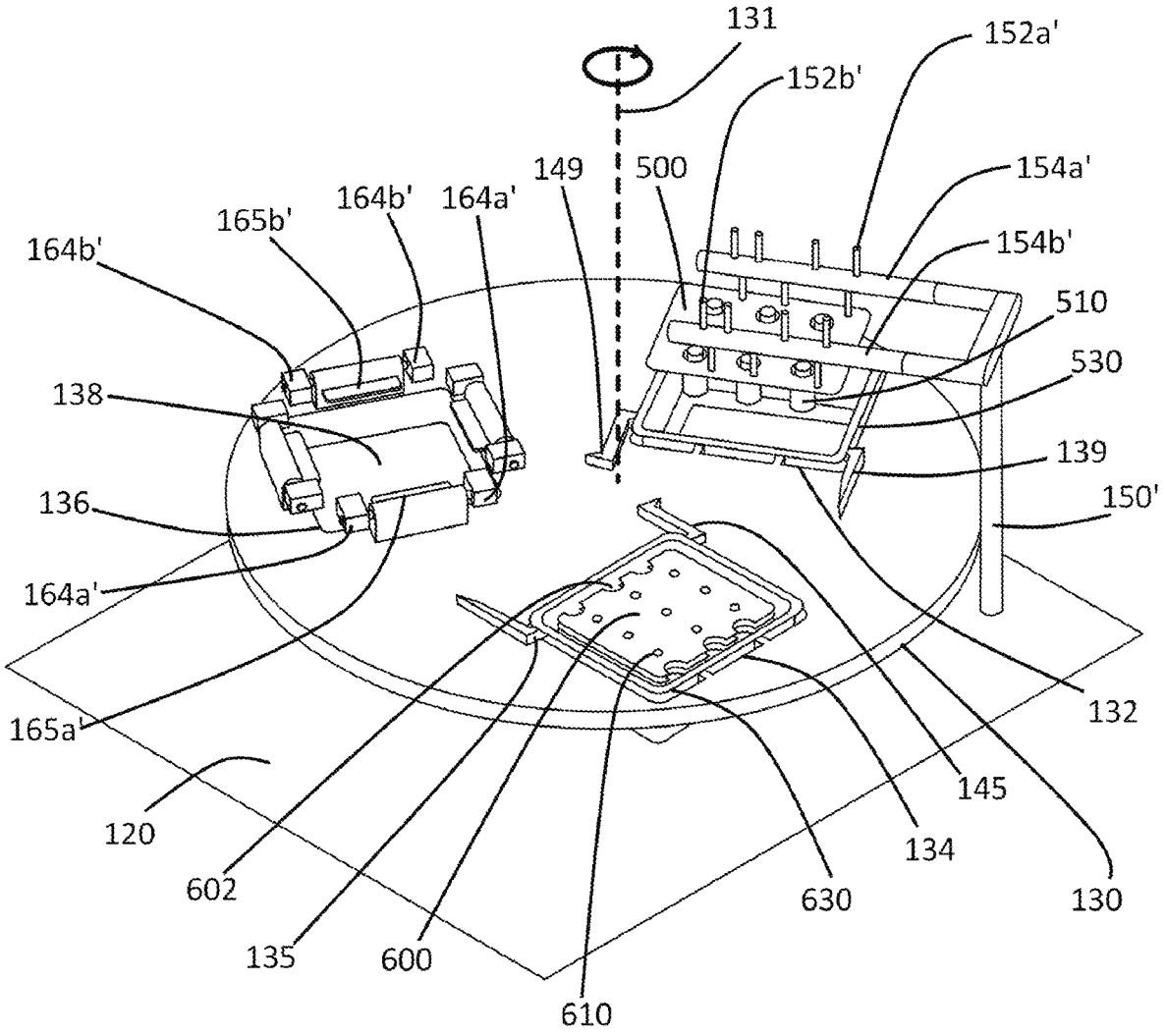
FIG. 5A is a drawing of subsystems of yet a further embodiment of an apparatus for filling pharmaceutical containers with a pharmaceutical fluid product.
Figure 5B:
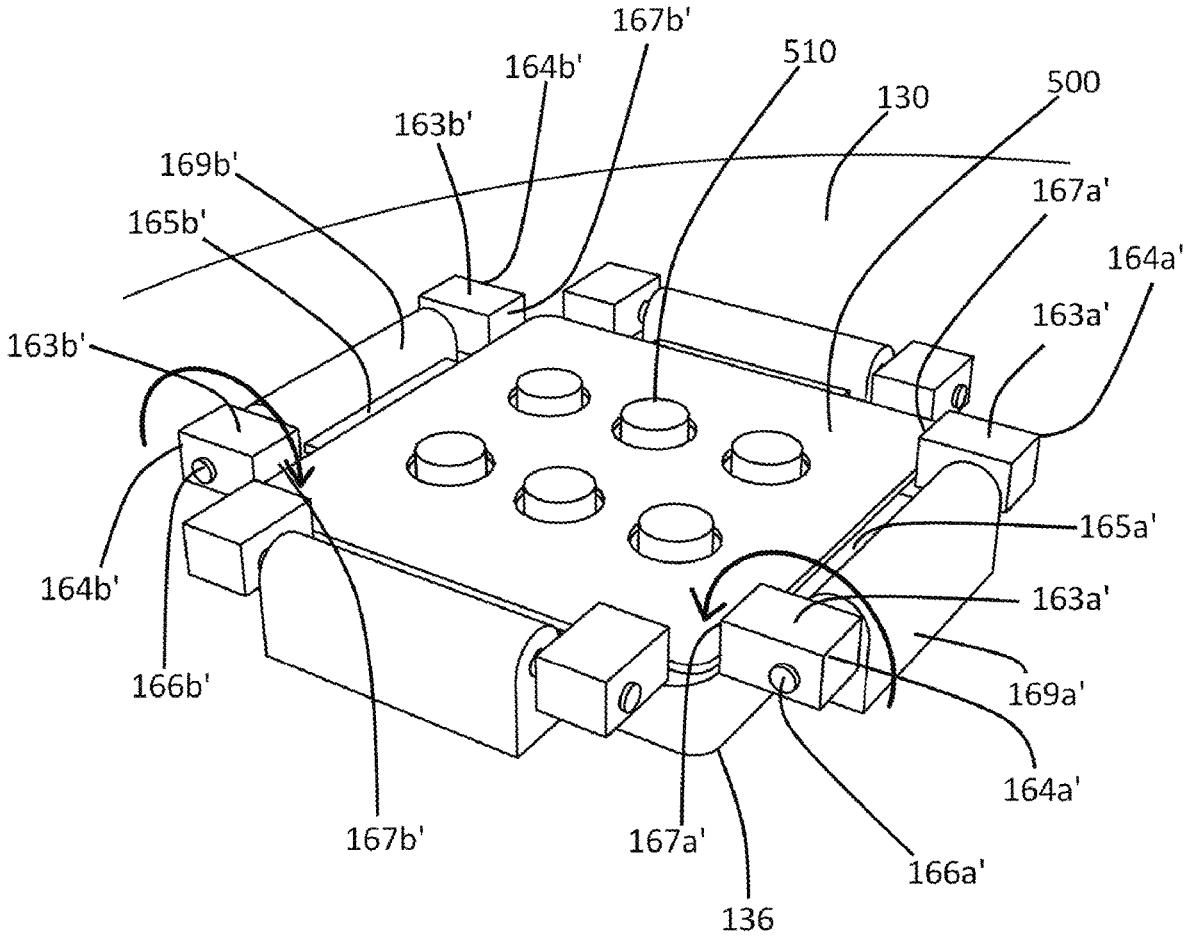
FIG. 5B shows a portion of FIG. 5A in more detail.

Another embodiment of rotary positioning elements is shown in FIG. 5A and FIG. 5B. In contrast with the embodiment of FIG. 4A and FIG. 4B described immediately above, the horizontal positioning and vertical positioning of a nest between two mutually counter-rotatable elements 164*a*' and 164*b*' in FIG. 5A and FIG. 5B are mutually independent positioning actions. This is achieved by employing, in each of the two mutually perpendicular planar dimensions addressed in the embodiment immediately above, a pair of fixed opposing planar tabs 165*a*' and 165*b*' to position nest 500 in the vertical dimension, and a pair of rotary positioning elements 164*a*' and 164*b*' to position nest 500 in the first horizontal dimension. In this embodiment, each of the elements 164*a*' and 164*b*' comprises two rotatable elements ganged on axles 166*a*' and 166*b*' respectively to rotate in unison and mutual alignment either side of planar tabs 165*a*' and 165*b*' within bosses 169*a*' and 169*b*' respectively. The sets of rotary elements 164*a*' and 164*b*', beyond each being divided in to two ganged elements, serve to confine the nest 500 in the horizontal dimension in the same fashion as rotary elements 164*a* and 164*b* in the embodiment of FIG. 4A and FIG. 4B described immediately above.

While elements 164*a*' and 164*b*' may be designed to be of more complex shape, we show in FIG. 5A and FIG. 5B a very simple implementation in which surfaces 167*a*' of rotary elements 164*a*' and surfaces 167*b*' of rotary elements 164*b*' serve to position nest 500 in the first horizontal dimension. By rotating elements 164*a*' joined by axle 166*a*' counter-clockwise within boss 169*a*' and rotating elements 164*b*' joined by axle 166*b*' clockwise within boss 169*b*', Surfaces 163*a*' and 163*b*' may be made to face each other and thereby a nest of different length in the first horizontal dimension may be positioned and accurately located between elements 164*a*' and 164*b*'.

Ganged elements 164*a*' and 164*b*' may be rotated manually about the axes of axles 166*a*' and 166*b*' respectively inside bosses 169*a*' and 169*b*' respectively. In some embodiments, the rotation of elements 164*a*' and 164*b*' may be done automatically by means of motorized drives controlled by controller 400 and suitable control software. That control may be based on predetermined dimensional data relating to the nest being positioned between the surfaces of elements 164*a*' and 164*b*'. It may also be based on input data derived from imaging data obtained from cameras 210 and/or 220. Further, the rotation may take place as the nest 500 is lowered into position so that the particular surfaces of elements 164*a*' and 164*b*' destined to engage with the opposing ends of the nest 500 along the first dimension may serve as closing horizontal grip on nest 500 as the surfaces rotate toward the position in which they face each other.

FIG. 5A and FIG. 5B show a further set of paired mutually counter-rotatable rotary positioning elements, not numbered for the sake of clarity, ganged similarly to rotary elements 164*a*' and 164*b*', and disposed to accurately locate nest 500 independently in the vertical dimension and in a second planar dimension of nest 500 perpendicular to the first dimension.

Figure 6:
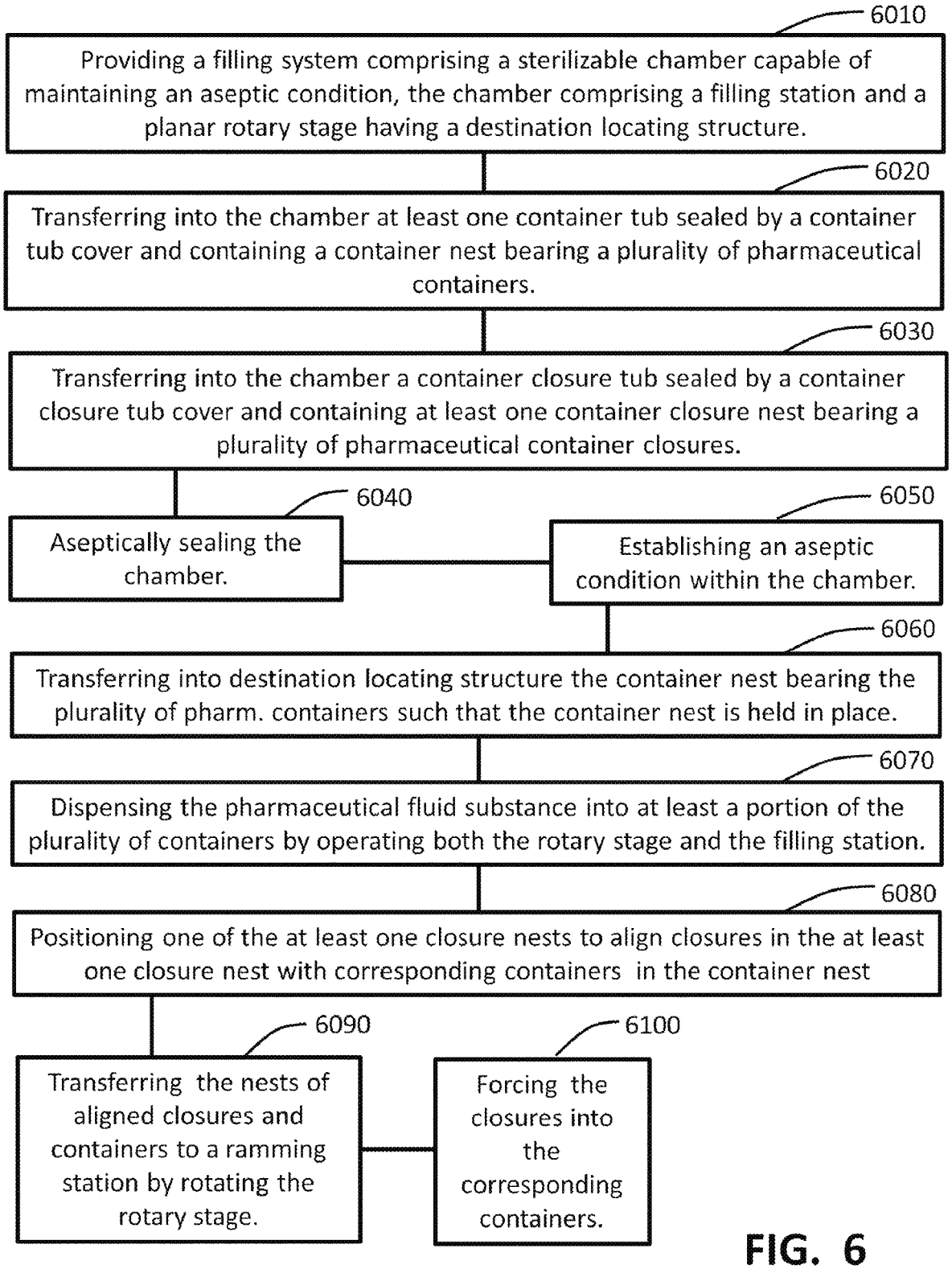
FIG. 6 shows a flow chart of a further method for filling nested pharmaceutical containers with a pharmaceutical fluid substance.

In a further aspect, described at the hand of FIG. 6, a method is provided for filling nested pharmaceutical containers 510 with a pharmaceutical fluid substance, the method comprising: providing [6010] a filling system 1000 comprising a sterilizable chamber 100 capable of maintaining an aseptic condition, the chamber 100 comprising a filling station 170 and a planar rotary stage 130 having a destination locating structure 136, 164*a*, 164*b*, 164*a*', 164*b*'; transferring [6020] into the chamber at least one container tub 530 sealed by a container tub cover 520 and containing a container nest 500 bearing a plurality of pharmaceutical containers 510; aseptically sealing [6040] the chamber 100; establishing [6050] an aseptic condition within the chamber 100; transferring [6060] into the destination locating structure 136, 164*a*, 164*b*, 164*a*', 164*b*' the container nest 500 bearing the plurality of pharmaceutical containers 510 such that the container nest 500 is held in place; and dispensing [6070] the pharmaceutical fluid substance into at least a portion of the plurality of pharmaceutical containers 510 by operating both the rotary stage 130 and the filling station 170. The operating the filling station 170 may include rotating the filling station 170. The dispensing the pharmaceutical fluid substance may comprise dispensing the pharmaceutical fluid substance on an iterative and serial basis into the containers 510.

The providing [6010] a filling system 1000 may comprise providing a filing apparatus comprising at least one cover removal station 140 within the chamber 100 and wherein the transferring into the destination locating structure the container tub 530 comprises removing the container tub cover 520 from the container tub 530 by operating both the rotary stage 130 and the at least one cover removal station 140. The operating the at least one cover removal station 140 may comprise rotating the at least one cover removal station 140. The providing [6010] the filling system 1000 may comprise providing within the chamber 100 at least one cover removal station 140 having an engagement tool 142, the transferring [6020] into the chamber 100 at least one container tub 530 may comprise attaching to the container tub 520 cover a cover removal fixture 540; and wherein the operating the at least one cover removal station 140 comprises engaging the engagement tool 142 with the cover removal fixture 540.

The method may further comprise transferring [6030] into the chamber a container closure tub 630 sealed by a container closure tub cover and containing at least one container closure nest 600 bearing a plurality of pharmaceutical container closures 610. The method may further comprise positioning [6080] one of the at least one closure nests 600 to align closures 610 in the at least one closure nest 600 with corresponding containers 530 in the container nest 500; transferring [6090] the nests 500,600 of aligned closures 610 and containers 510 to a ramming station by rotating the rotary stage 130; and forcing [6100] the closures 610 into the corresponding containers 510. The method may further include adjusting a tub locating structure 135,145 to accommodate a size of the closure nest tub 630. The positioning [6080] one of the at least one closure nest 600 may comprise: obtaining image information about the one of the at least one closure nests 600; and positioning the one of the at least one closure nests 600 based on the image information. The positioning [6080] one of the at least one closure nest 600 may comprise: applying a vacuum to suction cups 162, 152*a*, 152*b*, 152*a*', 152*b*'; lifting the container closure nest 600 with the suction cups; and operating the rotary stage 130.

The transferring [6020] into the destination locating opening the container nest 500 may comprise: applying a vacuum to the suction cups; lifting the container nest 500 with the suction cups; and operating the rotary stage 130. The method may further include selecting one of a plurality of sets of suction cups and wherein the applying a vacuum to suction cups is performed for the selected set of suction cups. The selecting may include rotating one of the plurality of sets of suction cups into position. The method may further include the destination locating structure 136, 164*a*, 164*b*, 164*a*', 164*b*' to accommodate a size of the container nest 500. The adjusting may be performed in two at least generally orthogonal directions. The method may further include adjusting a tub locating structure 139,149 to accommodate a size of the container nest tub 530.

In a further aspect, a method is provided (see FIG. 1G) for removing within a controlled environment enclosure a container cover from a sealed container, for example tub 530 or tub 630, the sealed container being sealed by the container cover, for example cover 520, the method comprising: providing the container in the controlled environment enclosure 100 with the cover 520 sealed to a sealing surface of a lip of the container to seal the contents of the container against decontamination, the cover 520 having a cover removal fixture 540, decontaminating the sealed container in the controlled environment enclosure 100, engaging the cover removal fixture 540 with an engagement tool 142, and removing the cover from the container using the engagement tool 142. The engaging may engage the cover removal fixture 540 with a fork-shaped engagement tool 142. The engaging may engage a ball-shaped appendage on the cover removal fixture 540.

The providing may include providing sterilized pharmaceutical containers 510 or closures 610 in the sealed container, for example tub 530 or 630, before the decontaminating. The attaching may take place before the container is in the controlled environment enclosure 100. The decontaminating the sealed container in the controlled environment enclosure 100 may take place before the removing the cover 520. The removing the cover 520 may include moving the engagement tool 142 relative to the container 530. The removing the cover 520 may include moving both the container 530 and the engagement tool 142. The method may further comprise attaching the cover removal fixture 540 to the cover 520 before providing the container 530 in the controlled environment enclosure.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A system for filling nested pharmaceutical containers with a pharmaceutical fluid substance, the system comprising a sterilizable chamber capable of maintaining an aseptic condition, the chamber comprising:

a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, the locating structures include surfaces associated with a first tub-holding opening in the rotary stage for holding a first tub containing at least one nest of containers, surfaces associated with a second tub-holding opening in the rotary stage for holding a second tub containing at least one nest of closures, and surfaces associated with a destination nest-holding opening in the rotary stage for holding at least one nest, and a container filling station having a dispensing head for filling the containers while they are held in a nest at one of the locating structures.

2. The system of claim 1 wherein the chamber further comprises at least one vacuum pickup system comprising suction cups disposed to engage with the container nest and container closure nest held on the rotary stage, the at least one vacuum pickup system being configured in combination with rotation of the rotary stage to lift a pharmaceutical container nest from a pharmaceutical container tub and to deposit the pharmaceutical container nest in the destination opening in combination with rotation of the rotary stage and to lift a pharmaceutical container closure nest from a pharmaceutical container closure tub and to deposit the container closure nest on top of the pharmaceutical container nest.

3. The system of claim 1 wherein at least one of the locating structures includes a reconfigurable locating structure with one or more adjustable positioning surfaces to position a tub with respect to the rotary stage.

4. The system of claim 3 wherein the reconfigurable locating structure includes at least one pair of a reconfigurable stopping member and a restraining member disposed opposite each other across an opening in the rotary stage to precisely position at a first predetermined position a tub that contains at least one nest.

5. The system of claim 4 wherein the stopping member is adjustable to stop the tub at the first predetermined position by a rotary adjustment and the restraining member is disposed to restrain the tub in the first predetermined position.

6. The system of claim 3 wherein at least a first of the reconfigurable locating structures includes a rotary positioning element having an axis of rotation parallel to a plane of the rotary stage and includes a plurality of different positioning surfaces that are selectable by rotating the rotary positioning element.

7. The system of claim 3 wherein at least one of the reconfigurable locating structures includes at least a first pair of opposing positioning elements that define positioning surfaces that oppose each other along a first positioning axis that is at least generally parallel to a plane of the rotary stage and at least a second pair of opposing positioning elements that define positioning surfaces that oppose each other along a second positioning axis that is at least generally parallel to a plane of the rotary stage and at least generally perpendicular to the first positioning axis.

8. The system of claim 1 further including at least one cover removal station positioned to remove covers from tubs containing at least one nest of pharmaceutical packaging materials held in one of the locating structures.

9. The system of claim 8, wherein the at least one cover removal station is rotatable about a cover removal station rotation axis parallel to the rotary stage rotation axis to remove the tub covers in combination with rotation of the rotary stage.

10. The system of claim 8, wherein the at least one cover removal station comprises an engagement tool disposed and configured to engage with a cover removal fixture on the tub cover.

11. The system of claim 1 wherein the filling station is configured to be rotatable about a filling station rotation axis parallel to the rotary stage rotation axis to position in combination with rotation of the rotary stage the dispenser head over any one of the plurality of pharmaceutical containers held by one of the one of the locating structures.

12. The system of claim 1, further comprising at least one camera disposed to obtain image information about at least one of the nests of pharmaceutical container parts.

13. The system of claim 1, further comprising a ram system configured for forcing nested closures into corresponding nested containers.

14. A system for filling nested pharmaceutical containers with a pharmaceutical fluid substance, the system comprising a sterilizable chamber capable of maintaining an aseptic condition, the chamber comprising:

a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, at least one of the locating structures includes a reconfigurable locating structure with one or more adjustable positioning surfaces to position a tub with respect to the rotary stage, at least a first of the reconfigurable locating structures includes a rotary positioning element having an axis of rotation parallel to a plane of the rotary stage and includes a plurality of different positioning surfaces that are selectable by rotating the rotary positioning element, and a container filling station having a dispensing head for filling the containers while they are held in a nest at one of the locating structures;

wherein at least one of the reconfigurable locating structures includes a pair of opposing rotary positioning elements each having an axis of rotation parallel to a plane of the rotary stage and each including a plurality of different positioning surfaces that are selectable by rotating that rotary positioning elements, to accommodate different nest widths.

15. A system for filling nested pharmaceutical containers with a pharmaceutical fluid substance, the system comprising a sterilizable chamber capable of maintaining an aseptic condition, the chamber comprising:

a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, at least one of the locating structures includes a reconfigurable locating structure with one or more adjustable positioning surfaces to position a tub with respect to the rotary stage, at least one of the reconfigurable locating structures includes at least a first pair of opposing positioning elements that define positioning surfaces that oppose each other along a first positioning axis that is at least generally parallel to a plane of the rotary stage and at least a second pair of opposing positioning elements that define positioning surfaces that oppose each other along a second positioning axis that is at least generally parallel to a plane of the rotary stage and at least generally perpendicular to the first positioning axis, and a container filling station having a dispensing head for filling the containers while they are held in a nest at one of the locating structures;

wherein at least one of the positioning elements in each of the first and second pairs of positioning elements includes a rotary positioning element having an axis of rotation parallel to a plane of the rotary stage and including a plurality of different positioning surfaces.

16. A system for filling nested pharmaceutical containers with a pharmaceutical fluid substance, the system comprising a sterilizable chamber capable of maintaining an aseptic condition, the chamber comprising:

a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, a container filling station having a dispensing head for filling the containers while they are held in a nest at one of the locating structures, and a reconfigurable vacuum pickup system comprising:

a first set of suction cups arranged in a first pattern, a second set of suction cups arranged in a second pattern different from the first pattern, and a selection mechanism operative to position either the first set of suction cups or the second set of suction cups to engage with the at least a first of the nests of pharmaceutical container parts while it is held by one of the plurality of locating structures.

17. The system of claim 16, wherein the selection mechanism of the reconfigurable vacuum pickup system includes a rotary mechanism operative to position the first or second sets of suction cups in an engagement position.

18. A system for filling nested pharmaceutical containers with a pharmaceutical fluid substance, the system comprising a sterilizable chamber capable of maintaining an aseptic condition, the chamber comprising:

a planar rotary stage having a rotary stage rotation axis, a plurality of locating structures positioned with respect to the rotary stage at different positions around the rotary stage rotation axis, for holding nests of pharmaceutical container parts at the different positions around the rotary stage rotation axis, a container filling station having a dispensing head for filling the containers while they are held in a nest at one of the locating structures, at least one rotatable cover removal station having a cover removal station rotation axis parallel to the rotary stage rotation axis;

at least one vacuum pickup system for placing a container closure nest on a container nest with closures in the closure nest in correspondence with containers in the container nest;

a ram system for forcing the closures into the containers; and wherein the filing station is a rotatable filling station having a filling station rotation axis parallel to the rotary stage rotation axis and comprising a fluid product dispenser head.

19. The system of claim 18, further comprising:

at least one camera for obtaining image information of at least one of the container nest and the closure nest, a controller comprising a memory and a processor, and wherein the controller is operative to instruct the rotary stage to rotate to angular positions that are one of predetermined and based on the image information and to control the at least one cover removal station, the filling station, the at least one vacuum pickup system, and the ram system to operate in conjunction with the rotary stage.

20. A method for filling nested pharmaceutical containers with a pharmaceutical fluid substance, the method comprising:

providing a filling system comprising a sterilizable chamber capable of maintaining an aseptic condition, the chamber comprising a filling station and a planar rotary stage having a destination locating structure;

transferring into the chamber at least one container tub sealed by a container tub cover and containing a container nest bearing a plurality of pharmaceutical containers;

aseptically sealing the chamber;

establishing an aseptic condition within the chamber;

transferring into the destination locating structure the container nest bearing the plurality of pharmaceutical containers such that the container nest is held in place;

dispensing the pharmaceutical fluid substance into at least a portion of the plurality of pharmaceutical containers by operating both the rotary stage and the filling station;

transferring into the chamber a container closure tub sealed by a container closure tub cover and containing at least one container closure nest bearing a plurality of pharmaceutical container closures;

positioning one of the at least one closure nests to align closures in the at least one closure nest with corresponding containers in the container nest;

transferring the nests of aligned closures and containers to a ramming station by rotating the rotary stage; and forcing the closures into the corresponding containers.

21. The method of claim 20, wherein the operating the filling station includes rotating the filling station.

22. The method of claim 20, wherein the dispensing the pharmaceutical fluid substance comprises dispensing the pharmaceutical fluid substance on an iterative and serial basis into the containers.

23. The method of claim 20, wherein the providing a filling system comprises providing a filing apparatus comprising at least one cover removal station within the chamber and wherein the transferring into the destination locating structure the container tub comprises removing the container tub cover from the container tub by operating both the rotary stage and the at least one cover removal station.

24. The method of claim 23, wherein operating the at least one cover removal station comprises rotating the at least one cover removal station.

25. The method of claim 23, wherein:

the providing the filling system comprises providing within the chamber at least one cover removal station having an engagement tool, the transferring into the chamber at least one container tub comprises attaching to the container tub cover a cover removal fixture; and wherein the operating the at least one cover removal station comprises engaging the engagement tool with the cover removal fixture.

26. The method of claim 20, further comprising transferring into the chamber a container closure tub sealed by a container closure tub cover and containing at least one container closure nest bearing a plurality of pharmaceutical container closures.

27. The method of claim 26, wherein the positioning one of the at least one closure nest comprises:

obtaining image information about the one of the at least one closure nests; and positioning the one of the at least one closure nests based on the image information.

28. The method of claim 26, wherein the positioning one of the at least one closure nest comprises:

applying a vacuum to suction cups;

lifting the container closure nest with the suction cups; and operating the rotary stage.

29. The method of claim 20, wherein the transferring into the destination locating opening the container nest comprises:

applying a vacuum to suction cups;

lifting the container nest with the suction cups; and operating the rotary stage.

30. A method for filling nested pharmaceutical containers with a pharmaceutical fluid substance, the method comprising:

providing a filling system comprising a sterilizable chamber capable of maintaining an aseptic condition, the chamber comprising a filling station and a planar rotary stage having a destination locating structure;

transferring into the chamber at least one container tub sealed by a container tub cover and containing a container nest bearing a plurality of pharmaceutical containers;

aseptically sealing the chamber;

establishing an aseptic condition within the chamber;

transferring into the destination locating structure the container nest bearing the plurality of pharmaceutical containers such that the container nest is held in place; and dispensing the pharmaceutical fluid substance into at least a portion of the plurality of pharmaceutical containers by operating both the rotary stage and the filling station;

transferring into the chamber a container closure tub sealed by a container closure tub cover and containing at least one container closure nest bearing a plurality of pharmaceutical container closures; and adjusting a tub locating structure to accommodate a size of the closure nest tub.

31. A method for filling nested pharmaceutical containers with a pharmaceutical fluid substance, the method comprising:

providing a filling system comprising a sterilizable chamber capable of maintaining an aseptic condition, the chamber comprising a filling station and a planar rotary stage having a destination locating structure;

transferring into the chamber at least one container tub sealed by a container tub cover and containing a container nest bearing a plurality of pharmaceutical containers;

aseptically sealing the chamber;

establishing an aseptic condition within the chamber;

transferring into the destination locating structure the container nest bearing the plurality of pharmaceutical containers such that the container nest is held in place by applying a vacuum to suction cups, lifting the container nest with the suction cups, and operating the rotary stage; and dispensing the pharmaceutical fluid substance into at least a portion of the plurality of pharmaceutical containers by operating both the rotary stage and the filling station; and selecting one of a plurality of sets of suction cups and wherein the applying a vacuum to suction cups is performed for the selected set of suction cups.

32. The method of claim 31, wherein the selecting includes rotating one of the plurality of sets of suction cups into position.

33. A method for filling nested pharmaceutical containers with a pharmaceutical fluid substance, the method comprising:

providing a filling system comprising a sterilizable chamber capable of maintaining an aseptic condition, the chamber comprising a filling station and a planar rotary stage having a destination locating structure;

transferring into the chamber at least one container tub sealed by a container tub cover and containing a container nest bearing a plurality of pharmaceutical containers;

aseptically sealing the chamber;

establishing an aseptic condition within the chamber;

transferring into the destination locating structure the container nest bearing the plurality of pharmaceutical containers such that the container nest is held in place; and adjusting the destination locating structure to accommodate a size of the container nest.

34. The method of claim 33, wherein the adjusting is performed in two at least generally orthogonal directions.

35. A method for filling nested pharmaceutical containers with a pharmaceutical fluid substance, the method comprising:

providing a filling system comprising a sterilizable chamber capable of maintaining an aseptic condition, the chamber comprising a filling station and a planar rotary stage having a destination locating structure;

transferring into the chamber at least one container tub sealed by a container tub cover and containing a container nest bearing a plurality of pharmaceutical containers;

aseptically sealing the chamber;

establishing an aseptic condition within the chamber;

transferring into the destination locating structure the container nest bearing the plurality of pharmaceutical containers such that the container nest is held in place; and adjusting a tub locating structure to accommodate a size of the container nest tub.

* * * * *